US011326608B2

(12) United States Patent
Mayleben

(10) Patent No.: US 11,326,608 B2
(45) Date of Patent: May 10, 2022

(54) THERMALLY CONTROLLED UTILITY PUMP AND METHODS RELATING TO SAME

(71) Applicant: Wayne/Scott Fetzer Company, Westlake, OH (US)

(72) Inventor: Philip Anthony Mayleben, Brookville, IN (US)

(73) Assignee: Wayne/Scott Fetzer Company, Westlake, OH (US)

( * ) Notice: Subject to any disclaimer, the term of this patent is extended or adjusted under 35 U.S.C. 154(b) by 342 days.

(21) Appl. No.: 16/102,436

(22) Filed: Aug. 13, 2018

(65) Prior Publication Data

US 2019/0048875 A1 Feb. 14, 2019

Related U.S. Application Data

(60) Provisional application No. 62/717,437, filed on Aug. 10, 2018, provisional application No. 62/700,102, filed on Jul. 18, 2018, provisional application No. 62/545,256, filed on Aug. 14, 2017.

(51) Int. Cl.
*F04D 15/02* (2006.01)
*F04D 29/58* (2006.01)
(Continued)

(52) U.S. Cl.
CPC ..... *F04D 15/0263* (2013.01); *F04D 13/086* (2013.01); *F04D 29/4293* (2013.01); *F04D 29/5806* (2013.01); *F04D 13/0606* (2013.01)

(58) Field of Classification Search
CPC ..... F04D 13/0606; F04D 13/086; F04D 15/0263; F04D 29/4293; F04D 29/5806
See application file for complete search history.

(56) References Cited

U.S. PATENT DOCUMENTS 2,333,243 A 11/1943 Glab
2,553,066 A 5/1951 Southern
(Continued)

FOREIGN PATENT DOCUMENTS

CN 203548187 4/2014
CN 201330537433 6/2014
(Continued)

OTHER PUBLICATIONS

Wikipedia, :Redundancy (engineering), 2016.*
(Continued)

*Primary Examiner* — Christopher S Bobish
(74) *Attorney, Agent, or Firm* — Fitch, Even, Tabin & Flannery LLP

(57) ABSTRACT

A multi-outlet fluid pump includes a housing, a motorized pump, an electrical power supply, and a self-locking thermal cutoff. In one form, the pump includes a first or primary thermal cutoff and a second or secondary thermal cutoff to prevent the pump from operating once a thermal cutoff has deactivated the pump until a user or operator has taken some affirmative action. Related methods are also disclosed herein. In some forms an indicator is provided to indicate if the thermal cutoff has disabled the pump to alert a user as to the need to unplug or reset the pump before operating the pump again.

10 Claims, 30 Drawing Sheets

(51) Int. Cl.

| | |
|---|---|
| ***F04D 29/42*** | (2006.01) |
| ***F04D 13/08*** | (2006.01) |
| ***F04D 13/06*** | (2006.01) |

(56) References Cited

U.S. PATENT DOCUMENTS 2,763,214 A 9/1956 White
2,863,525 A 12/1958 Lucian
3,260,214 A 7/1966 Goettl
3,400,732 A 9/1968 Larrabee
3,667,870 A * 6/1972 Na ..... H02K 5/128 417/357
3,684,096 A 8/1972 Kretchman
3,822,967 A 7/1974 Cade
3,899,726 A * 8/1975 Ellmore ..... H01H 35/006 318/472
3,936,240 A 2/1976 Dochterman
D243,281 S 2/1977 Pareja
D252,811 S 9/1979 Arakawa
4,275,995 A 6/1981 Taylor
4,435,879 A 3/1984 Kornelis
4,482,300 A 11/1984 Brown
4,645,426 A 2/1987 Hartley
4,820,131 A 4/1989 Johnson
4,961,018 A 10/1990 Akhter
5,055,000 A 10/1991 Akhter
D328,304 S 7/1992 Frohn
5,131,821 A 7/1992 Marioni
D329,651 S 9/1992 Kuwada
5,145,322 A * 9/1992 Senior, Jr. ..... F04D 15/0263 184/6.4
5,145,337 A 9/1992 Kirkland
5,181,841 A 1/1993 Kirkland
5,205,725 A 4/1993 Pattison
D335,292 S 5/1993 Schnell
5,494,414 A 2/1996 Steinhart
5,525,039 A * 6/1996 Sieghartner ..... F04D 5/002 417/244
D372,034 S 7/1996 Handzel
5,599,164 A 2/1997 Murray
D394,067 S 5/1998 Kon
5,819,848 A * 10/1998 Rasmuson ..... F04B 49/065 166/250.15
5,833,437 A 11/1998 Kurth
5,997,261 A * 12/1999 Kershaw ..... H02K 9/19 417/366
6,049,666 A 4/2000 Bennett
6,059,542 A 5/2000 Chou
6,149,390 A * 11/2000 Fisher ..... F04D 15/0218 417/40
6,375,430 B1 4/2002 Eckert
6,390,780 B1 5/2002 Batchelder
6,423,218 B1 * 7/2002 Lindermeir ..... A01K 63/047 210/170.09
6,443,715 B1 9/2002 Mayleben
6,464,531 B2 10/2002 Eckert
D466,527 S 12/2002 Graber
6,530,758 B1 3/2003 Ritter
6,575,714 B2 6/2003 Pace
6,676,382 B2 1/2004 Leighton
D501,486 S 2/2005 Leone
D517,570 S 3/2006 Stiles, Jr.
7,153,418 B2 12/2006 Mauro, Sr.
7,264,449 B1 9/2007 Harned
D555,089 S 11/2007 Lutz
D589,060 S 3/2009 Metcalfe
7,544,041 B2 6/2009 Mayleben
D602,501 S 10/2009 Ton
7,597,732 B2 10/2009 Yokota
D603,870 S 11/2009 Mehnert
D611,504 S 3/2010 Ton
D667,466 S 9/2012 Moormann
8,297,952 B2 10/2012 Wu
8,380,355 B2 2/2013 Mayleben
8,529,228 B1 9/2013 Thompson
D691,638 S 10/2013 Alexander
D698,368 S 1/2014 Le
8,633,623 B2 1/2014 Bingler
8,636,898 B2 1/2014 Perez
D706,834 S 6/2014 John
D707,718 S 6/2014 Gomez
8,794,936 B2 8/2014 Tokuo
D738,402 S 9/2015 Nelson
D739,919 S 9/2015 Alexander
D744,003 S 11/2015 Ton
9,399,976 B2 7/2016 Ramamurthy
D769,332 S 10/2016 Varini
9,605,688 B2 3/2017 Perez
D788,932 S 6/2017 Ton
9,714,665 B2 * 7/2017 Saccoccio ..... F04D 29/426
9,768,662 B2 * 9/2017 Urata ..... H02K 5/20
9,810,241 B2 11/2017 Gell, III
D817,363 S 5/2018 Alexander
9,964,111 B2 * 5/2018 Yano ..... F04D 15/0263
D823,345 S 7/2018 Cooper
D823,898 S 7/2018 Alexander
D836,677 S 12/2018 Alexander
D848,487 S 5/2019 van Opdorp
D868,117 S 11/2019 Mayleben
D875,142 S 2/2020 Wilds
D890,211 S 7/2020 Cooper
10,711,788 B2 7/2020 Mayleben
D893,552 S 8/2020 Mayleben
10,760,586 B2 * 9/2020 Saccoccio ..... F04D 29/4293
D910,719 S 2/2021 Cooper
10,907,638 B2 2/2021 Wilds
D914,060 S 3/2021 Cooper
10,969,149 B2 * 4/2021 Schulaks ..... G05B 15/02
D918,268 S 5/2021 Cooper
11,162,496 B2 11/2021 Mayleben
2003/0002996 A1 1/2003 Pace
2003/0091440 A1 5/2003 Patel
2003/0161732 A1 8/2003 Kimberlin
2004/0040707 A1 * 3/2004 Dusterhoft ..... E21B 43/267 166/279
2005/0201858 A1 9/2005 Wang
2005/0231899 A1 10/2005 Barnes
2006/0064954 A1 3/2006 Yokota
2006/0083630 A1 4/2006 Chen
2006/0275162 A1 12/2006 Mayleben
2007/0175225 A1 * 8/2007 Bahat ..... G05D 23/1919 62/3.7
2008/0199326 A1 * 8/2008 Masoudipour ..... F04D 29/0513 417/247
2011/0123357 A1 * 5/2011 Leone ..... F04D 13/066 417/61
2013/0214895 A1 8/2013 Ullermann
2014/0166109 A1 6/2014 Takai
2014/0286747 A1 9/2014 Fang
2014/0341752 A1 11/2014 Gell, III
2015/0167673 A1 6/2015 Saccoccio
2015/0308425 A1 10/2015 Skotty
2016/0037987 A1 2/2016 Caro
2017/0030371 A1 2/2017 Wilds
2019/0048875 A1 2/2019 Mayleben
2019/0154061 A1 * 5/2019 Gilliland ..... A47J 43/085
2019/0309757 A1 * 10/2019 Rejniak ..... F04D 15/0218

FOREIGN PATENT DOCUMENTS

EM 000673363 2/2007
EM 000777123 8/2007
EM 001379309 7/2013
EM 001388441 10/2013
EM 0027086770002 5/2015
EM 0027086770004 5/2015
EP 1178212 2/2002
EP 1178212 A2 * 2/2002 ..... F04D 29/5806
EP 1241357 9/2002
EP 3058800 A1 8/2016
GB 1320841 A * 6/1973 ..... H02K 5/128
RU 2489784 7/2013

(56) References Cited

FOREIGN PATENT DOCUMENTS

| | | |
|---|---|---|
| RU | 166537 | 11/2016 |
| WO | 0017521 | 3/2000 |
| WO | 2006137777 | 12/2006 |
| WO | 2011137425 | 11/2011 |
| WO | 2012037991 | 3/2012 |

OTHER PUBLICATIONS amazon.com, Apple MFi Certified Lightning to USB Cable, Built-in LED in Lightning Connector, Heavy Duty Charge & Sync Cable, showing a product that was on sale or publicly disclosed more than a year before the filing date of the instant application, 13 pp.
Blue Angel Pump Company, Blue Angel Catalog, 2018, 34 pp.
Blue Angel Pump Company, Blue Angel Catalog, Oct. 2015, 39 pp.
Wayne Water Systems, Wayne Catalog, Oct. 2014, 52 pp.
Wayne/Scott Fetzer Company, Operating Instructions and Replacement Parts List, Submersible Utility Pumps VIP Series, that discloses a pump that was on sale or publicly disclosed more than 1 year before the filing date of the instant application, 2011,12 pp.
Wayne/Scott Fetzer Company, Watering & System Installation Guide, Dewatering Pump TSC, that discloses a pump that was on sale or publicly disclosed more than 1 year before the filing date of the instant application, 2016, 11 pp.
Patent Cooperation Treaty, International Searching Authority, Notification of Transmittal of the International Search Report and the Written Opinion of the International Searching Authority, or the Declaration issued in International Application No. PCT/US2018/046604, dated Nov. 29, 2018, 11 pp.
Wayne Water Systems, Wayne TSC Submersible Utility Pump Operating Instructions and Parts Manual, Jan. 2000, pp. 1-4, 2 pp.
Wayne Water Systems, Wayne TSC130/250 Submersible Utility Pump Operating Instructions and Parts Manual, Nov. 1999, pp. 1-4, 2 pp.
Wayne/Scott Fetzer Company, Wayne TSC130 Dewatering Pump Operating Instructions and Parts Manual, May 20, 2016, pp. 1-8, 8 pp.
Wayne/Scott Fetzer Company, Wayne TSC160 Dewatering Pump Warranty & System Installation Guide, May 20, 2016, pp. 1-11, 11 pp.

* cited by examiner

THERMALLY CONTROLLED UTILITY PUMP AND METHODS RELATING TO SAME

CROSS REFERENCE TO RELATED APPLICATIONS

This application claims the benefit of U.S. Provisional Application No. 62/717,437, filed Aug. 10, 2018, U.S. Provisional Application No. 62/700,102, filed Jul. 18, 2018, and U.S. Provisional Application No. 62/545,256, filed Aug. 14, 2017, all of which are incorporated herein by reference in their entirety.

FIELD OF TECHNOLOGY

The present disclosure generally describes fluid pumping devices. More specifically, the present disclosure describes electrically powered motorized pumps for residential use, indicators for use with same, power cords with LEDs for use with same and related methods.

BACKGROUND

Residential electric motor driven utility pumps can use various techniques to move water and other fluids from one location to another. Such pumps operate by drawing fluid into the main pump body and then discharging the fluid through an outlet. The outlet can be attached to a conduit, such as a standard garden hose, to deliver the discharged fluid to a separate location.

Utility pumps typically provide discharge outlets in one of two locations. More specifically, utility pumps typically employ either a top (axial) discharge outlet 502 as shown in FIGS. 5A-B, or a side (radial) discharge outlet 604, as shown in FIGS. 6A-B. Each of these different pumps having their own benefits and drawbacks. For example, pumps with top discharge outlets 500 typically occupy a smaller footprint and can fit into tight locations, but tend to be less stable, and more prone to tipping over, especially when an attached hose is moved. On the other hand, the side discharge units 600 are more stable, but require a larger footprint due to the space needed for the hose attachment. Not surprisingly, top discharge units are typically desired for applications where the pump is being used to deliver fluid (e.g., water) in a generally vertical direction (or not substantially horizontally), and side discharge units are desired for applications where the pump is being used to deliver fluid in a generally lateral direction (or not substantially vertically) from a location within the same proximate plane.

Additionally, utility pumps sometimes have thermal cutoffs ("TCOs") that act as safety shutoffs. These thermal safety shutoffs are often required by certification organizations to receive certain safety or quality certifications. When the pump overheats, the TCO cuts power to the pump motor until the pump cools. However, if the condition that caused the pump to overheat remains, the pump continuously cycles on and off as a result of the TCO's action (e.g., the TCO is triggered due to heat and causes an initial shutoff, the pump then starts to operate again once the heat dissipates, but then the TCO is triggered again once the temperature rises again, thereby causing on/off cycling).

Accordingly, it has been determined that a need exists for an improved indicator, pump and methods for operating an indicator or controlling a pump using same which overcome the aforementioned limitations, and which further provide capabilities, features and functions, not available in current sensors and pumps.

BRIEF DESCRIPTION OF THE DRAWINGS

Described herein are embodiments of systems, methods and apparatus for addressing these shortcomings.

This description includes drawings, wherein.

Figure 1A:
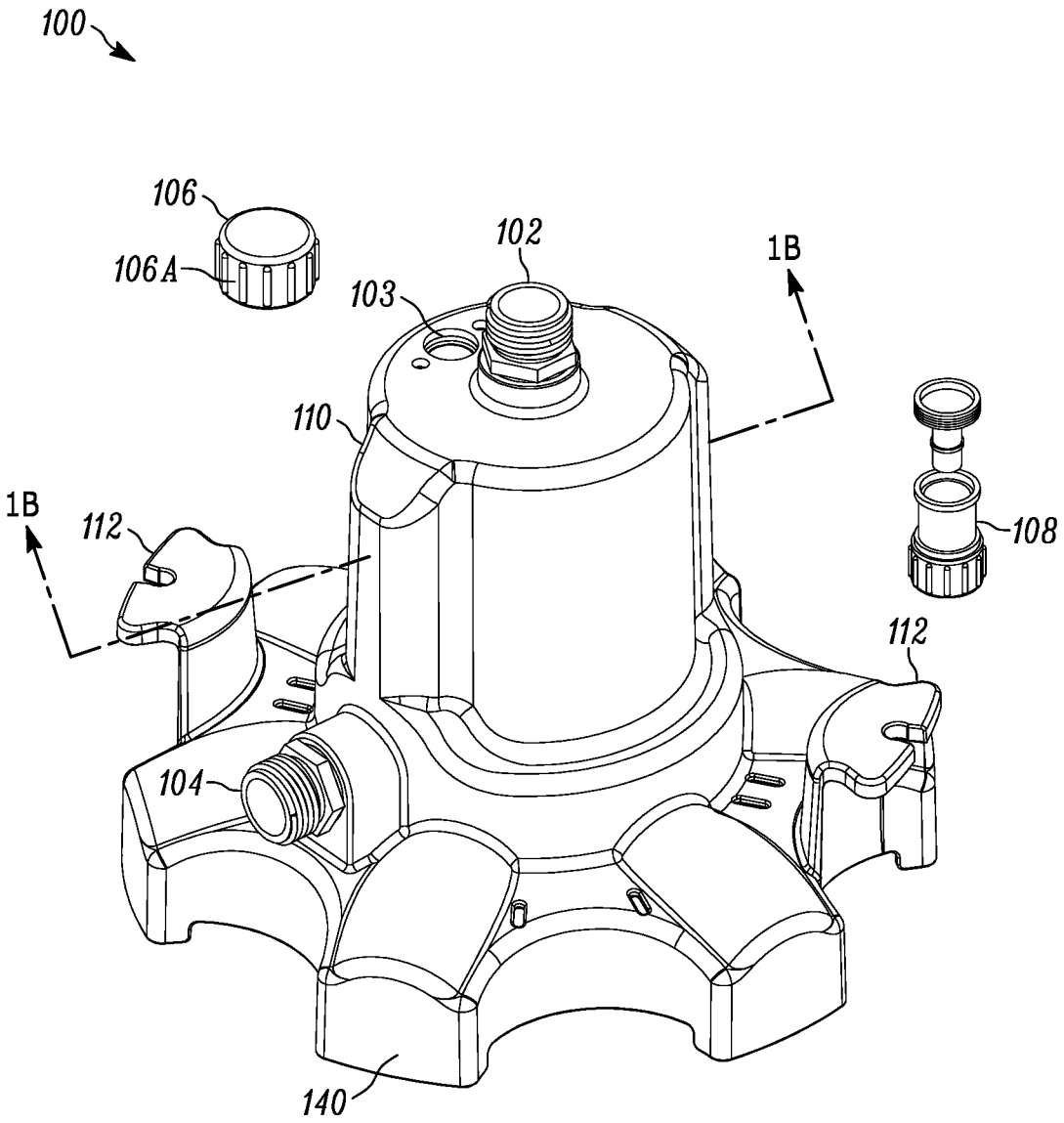
FIG. 1A is a perspective view as viewed from above of a multi-outlet fluid pump illustrating a cord-wrap mechanism and various types of sealing mechanisms.
Figure 1B:
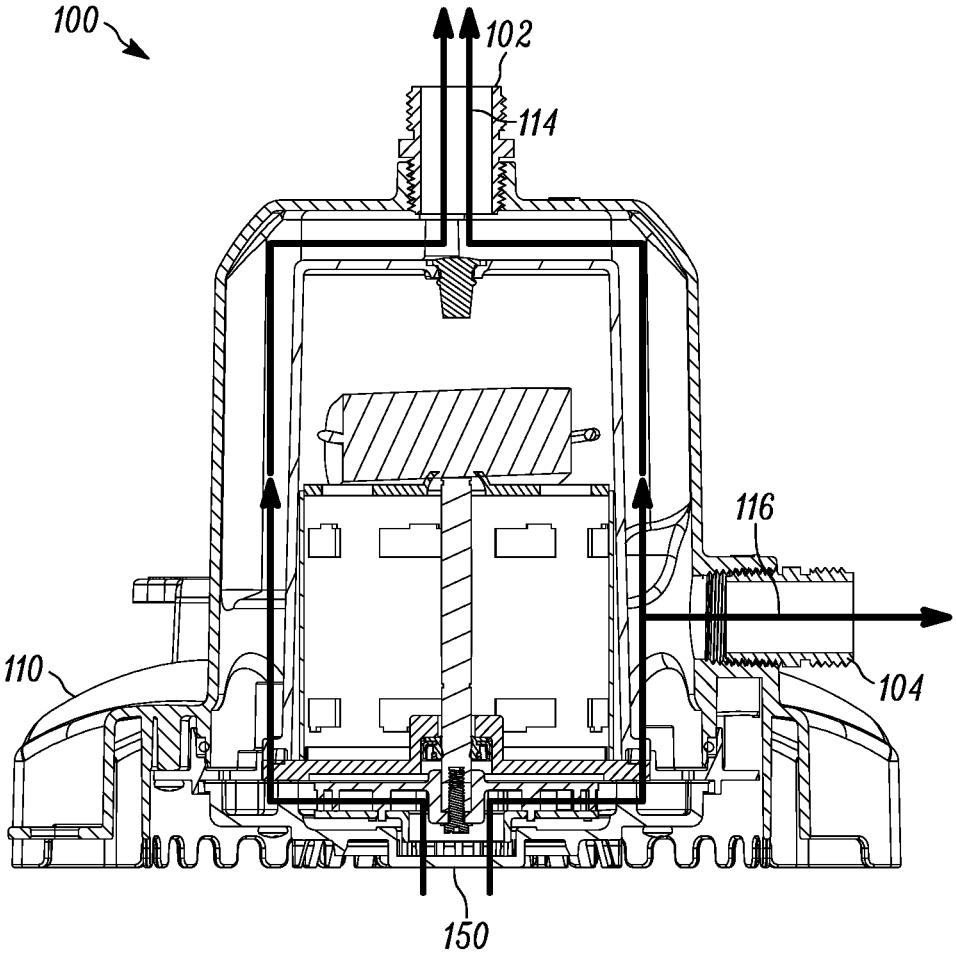
FIG. 1B is a cross-sectional view taken along lines 1B-1B in FIG. 1A of the multi-outlet fluid pump of FIG. 1A and shows various fluid flow paths within the pump.

Corresponding reference characters in the attached drawings indicate corresponding components throughout the several views of the drawings. In addition, elements in the figures are illustrated for simplicity and clarity and have not necessarily been drawn to scale. For example, the dimensions of some of the elements in the figures may be exaggerated relative to other elements to help to improve understanding of various embodiments. Also, common but well-understood elements that are useful or necessary in a commercially feasible embodiment are often not depicted or described in order to facilitate a less obstructed view of the illustrated elements and a more concise disclosure.

DETAILED DESCRIPTION

The present disclosure describes pumps with discharge outlets in multiple locations, for example, on both the top and the side. These pumps take advantage of the benefits, while minimizing the drawbacks, of pumps with only a single discharge outlet.

The present disclosure describes a pump that provides for either top or side discharge capabilities (or both) using a unique pump and pump housing design. A user can select the discharge location by attaching a conduit device (e.g., a garden hose) to one discharge outlet and sealing the other discharge outlet. For example, the user can install a threaded cap (which can be tethered to pump, for example, via a tether) onto the other discharge outlet.

Figure 5A:
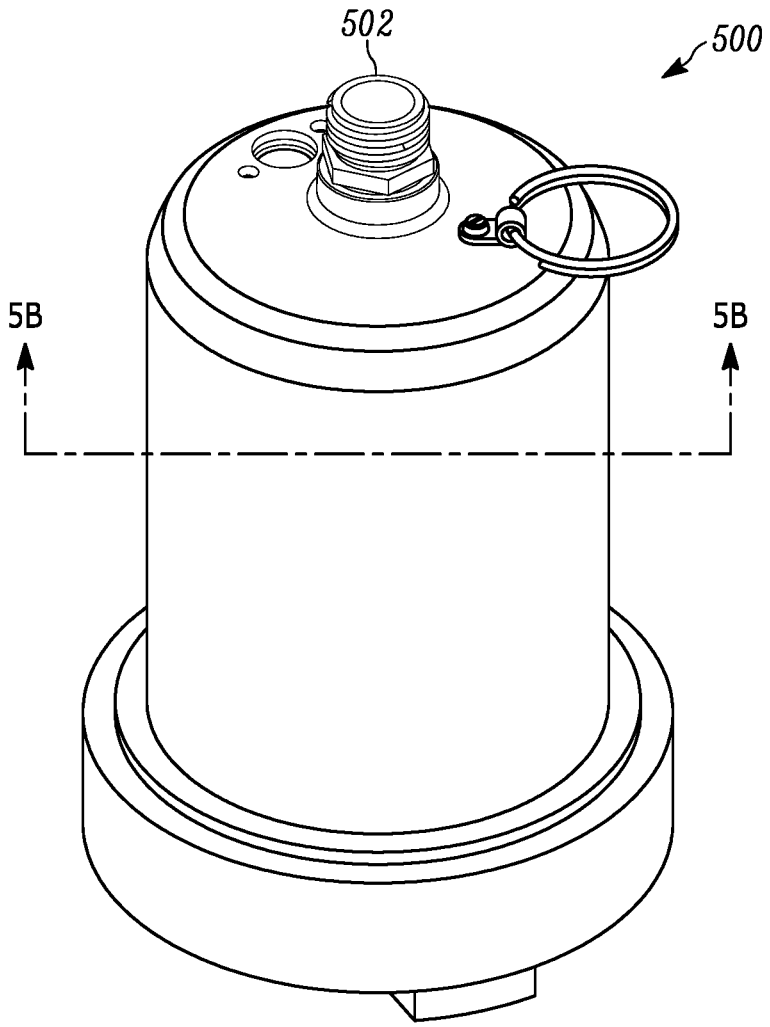
PRIOR ART FIGURE 5A
FIG. 5A is a perspective view of a conventional pump with a top discharge outlet.
Figure 5B:
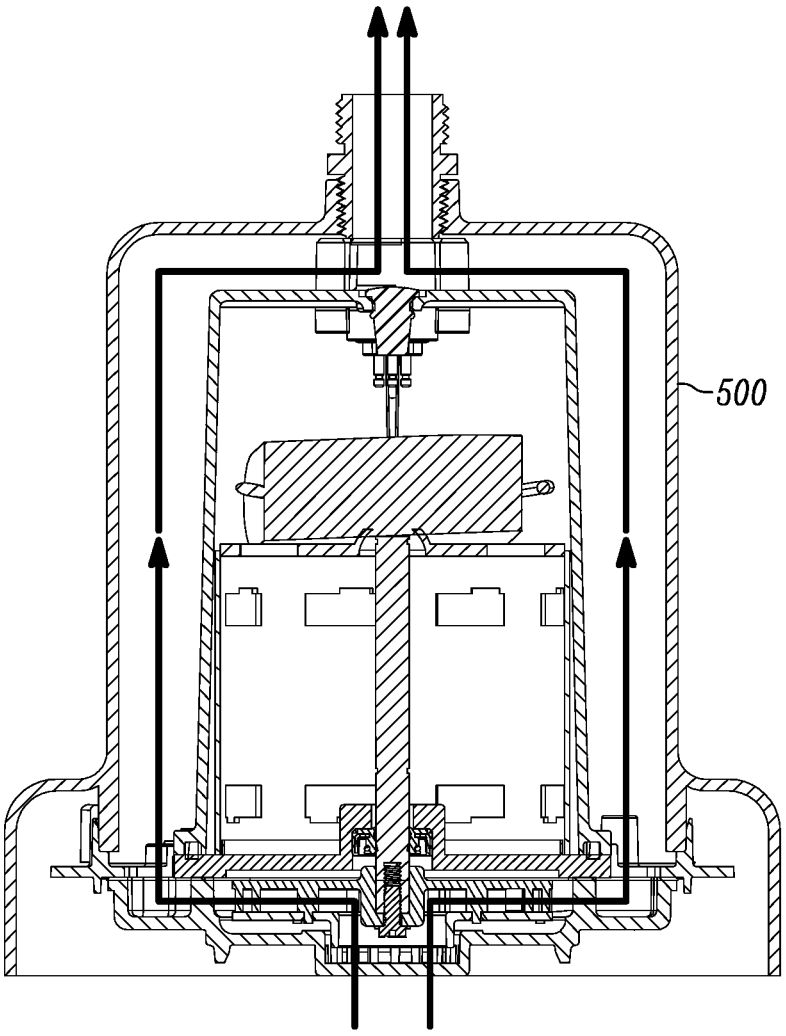
PRIOR ART FIGURE 5B
FIG. 5B is a cross-sectional view of the conventional pump of FIG. 5A taken along line 5B-5B, and shows the fluid flow path within the pump.
Figure 6A:
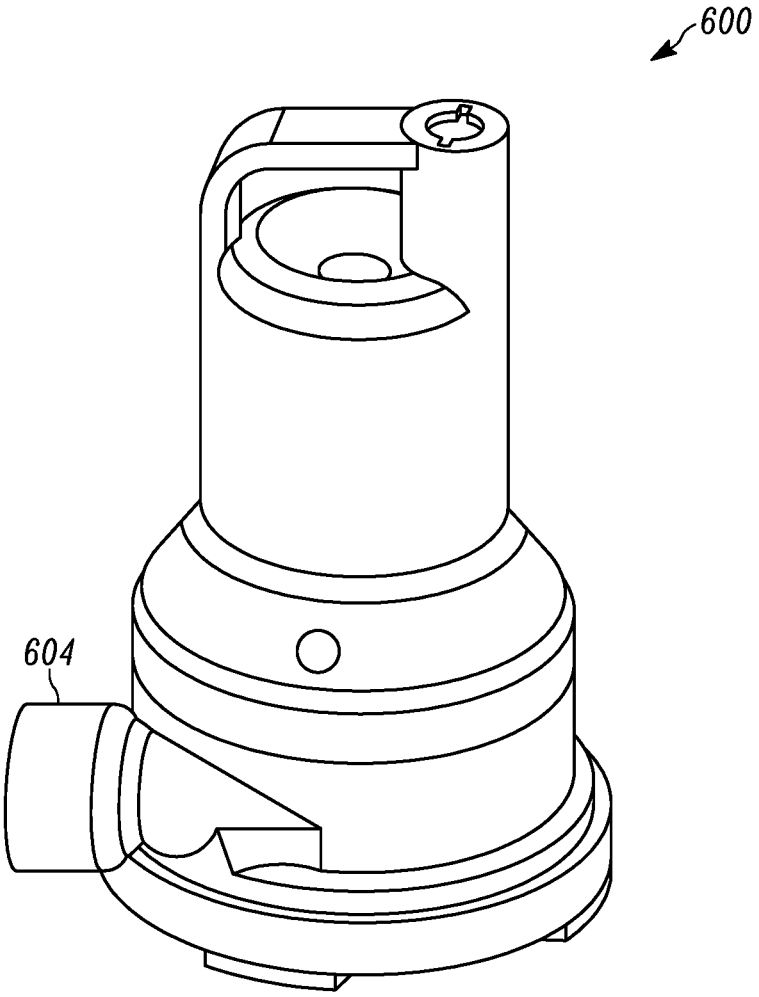
PRIOR ART FIGURE 6A
FIG. 6A is a perspective view of a conventional pump with a side discharge outlet.
Figure 6B:
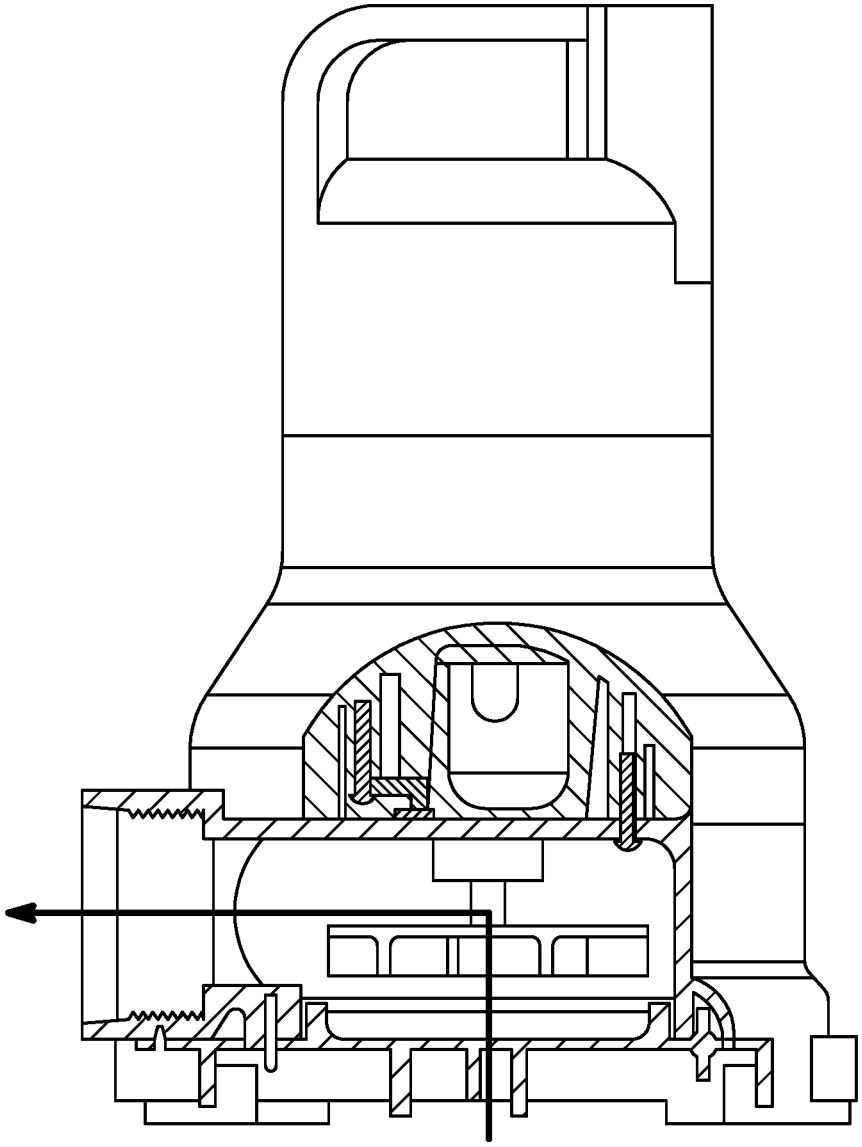
PRIOR ART FIGURE 6B
FIG. 6B is a side elevation view in partial cross-section of the conventional pump of FIG. 6A, and shows the fluid flow path within the pump.

Existing top discharge utility pumps 500 (see FIGS. 5A-B) utilize a second housing creating a water jacket, or a passageway to move water from the diffuser up the pump body and discharge from the top of the housing. Alternatively, side discharge pumps 600 (see FIGS. 6A-B) do not use a water jacket but rather discharge the water radially near the impeller centerline.

The presently described multi-outlet pump 100 combines both of these features into one unique housing 110 that allows for user changeable discharge depending on the application.

Certain embodiments also employ a design that filters debris from the pump. The proposed design reduces clogging during operation by way of multiple sets of progressively reduced openings to filter debris from large too small. This feature also allows for easy, tool-less cleaning of collected debris. That is, the use of multiple sets of progressively reduced openings allows for the filter of debris from large too small.

Figure 7A:
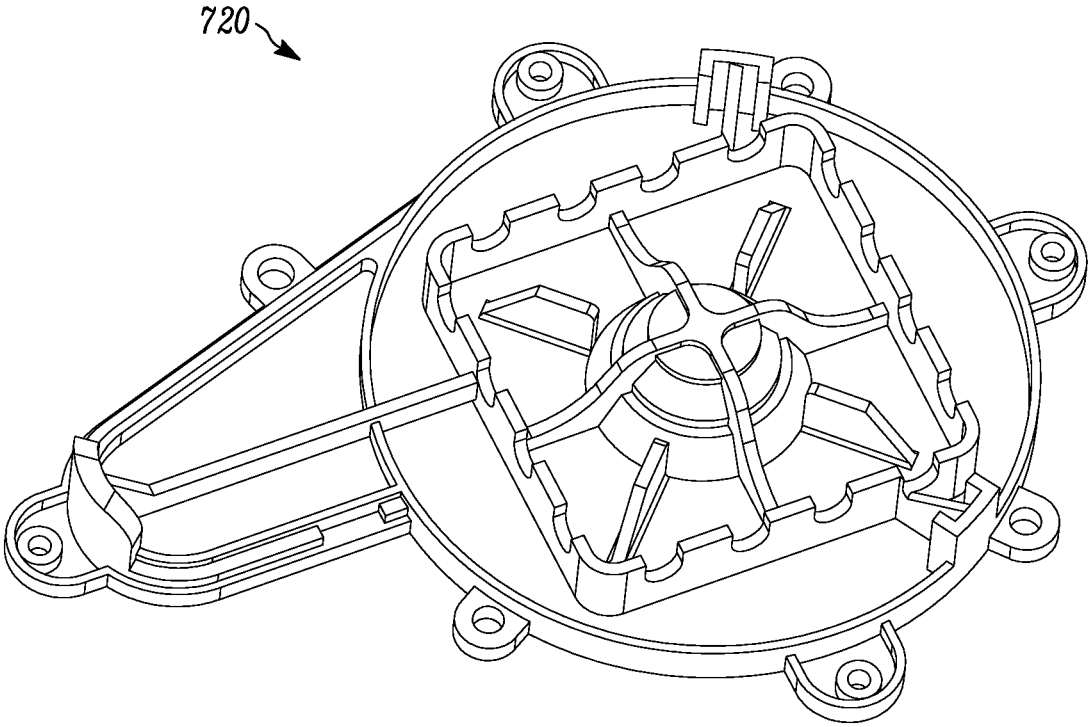
PRIOR ART FIGURE 7A
FIG. 7A is a perspective view of a conventional pump debris filter.
Figure 7B:
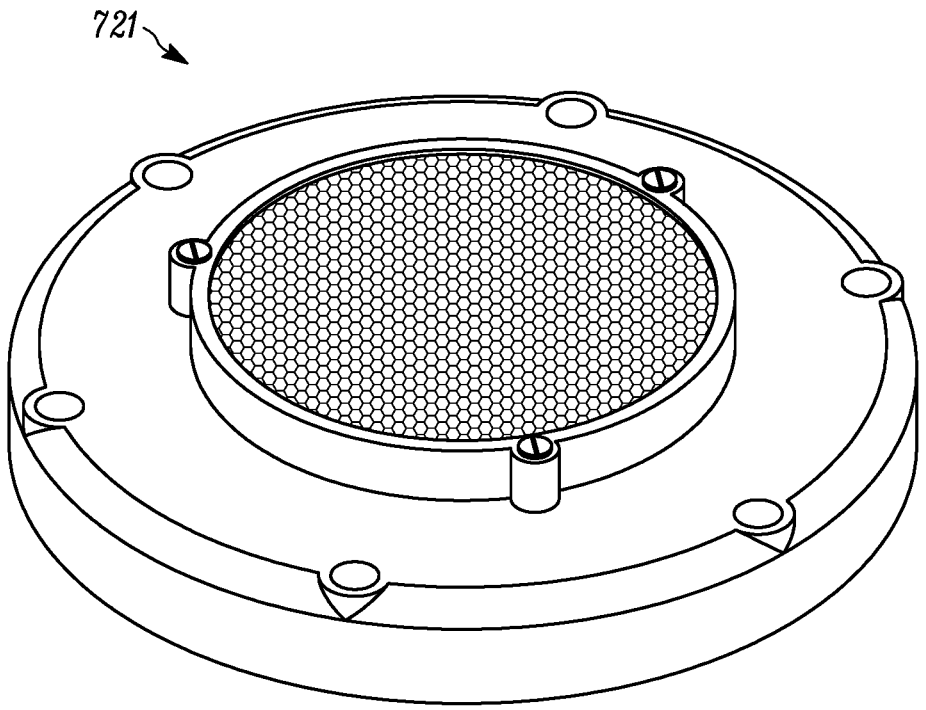
PRIOR ART FIGURE 7B
FIG. 7B is a perspective view of an alternate conventional pump debris filter.

Existing pumps use various openings, obstructions, and screens to filter debris and reduce pump clogging. For example, FIG. 7A shows a plastic filter 720 with teeth, and FIG. 7B shows a screen-type filter 721. Some aspects of the presently described pump use a filter or a similar feature that employs multiple sets of specific sized openings and specific placement to reduce clogging.

The present disclosure also provides a unique housing design that includes an integrated cord wrap system which serves as handles, plus a molded in feature to allow for hanging during storage.

In some embodiments, the top and side discharge outlets can include or be fitted with quick-release fittings. The quick-release fittings can be configured to automatically close-off the unused discharge outlet and allow for quick attachment to a conduit device, such as a garden hose.

In some aspects, the pump may be cordless, and operate with an interchangeable and rechargeable battery pack. In some examples the battery pack can provide a direct current electrical power supply to the pump.

Some examples of the presently disclosed pump provide a user with the ability to convert easily from a top discharge to a side discharge pump. This allows the user to handle a range of residential water pumping applications with a single product.

In some examples, the presently described pump can be made, at least partially, with injection mold tooling.

Some examples of the presently described pump can be used to remove water from pool covers, small swimming pools, hot tubs, flooded window wells, low spots on lawns, flooded basements, flat roofs, stock tanks, rain barrels, and the like.

FIGS. 1A-E present exemplary embodiments of a multi-outlet fluid pump 100. (As described herein, a multi-outlet fluid pump may be referred to as a fluid pumping apparatus, a pumping apparatus, or simply, a "pump.") In some examples the pump 100 has a pump housing 110, and a motorized pump. The motorized pump can be an oil filled pump, or an oil free pump. In some situations, it can be useful to provide pumps that are oil free, for example, in situations where the pump is used in a pool, in connection with aquatic life, etc.

Figure 9:
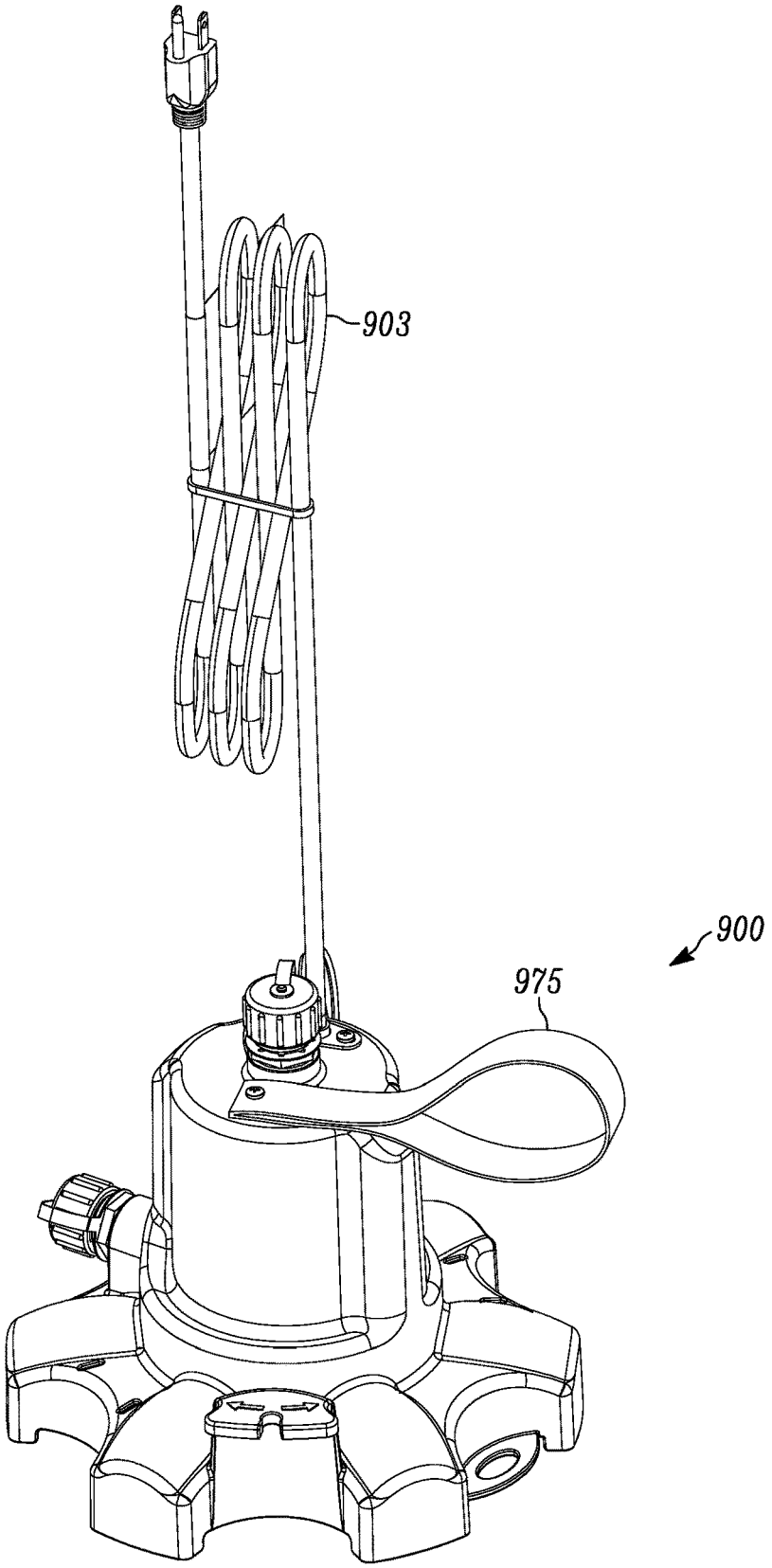
FIG. 9 is a perspective view of an alternate pump with a strap handle and an AC power cord.

An electrical power source supplies electrical power to the motorized pump. The electrical power supply can include an electrical cord for plugging into an AC power supply. FIG. 9 shows an example of a pump 900 with an AC power cord 903 extending from the top of the pump 900. In some embodiments, the pump can be configured to start automatically once plugged in. However, in alternate embodiments, the pump may include actuators or switches that control the turning on/off or other functionality of the pump. (See, e.g., FIGS. 4A and 4B.) For example, the actuators or switches for the pump can include, but are not limited to, on/off switches, tilt switches such as float switches, pressure or pneumatic switches, capacitive sensor switches, etc. Although not shown, in some examples, switches could also be used to seal one or more of the discharge outlets, thereby controlling from which outlet the pump discharges fluid if desired.

Figure 4A:
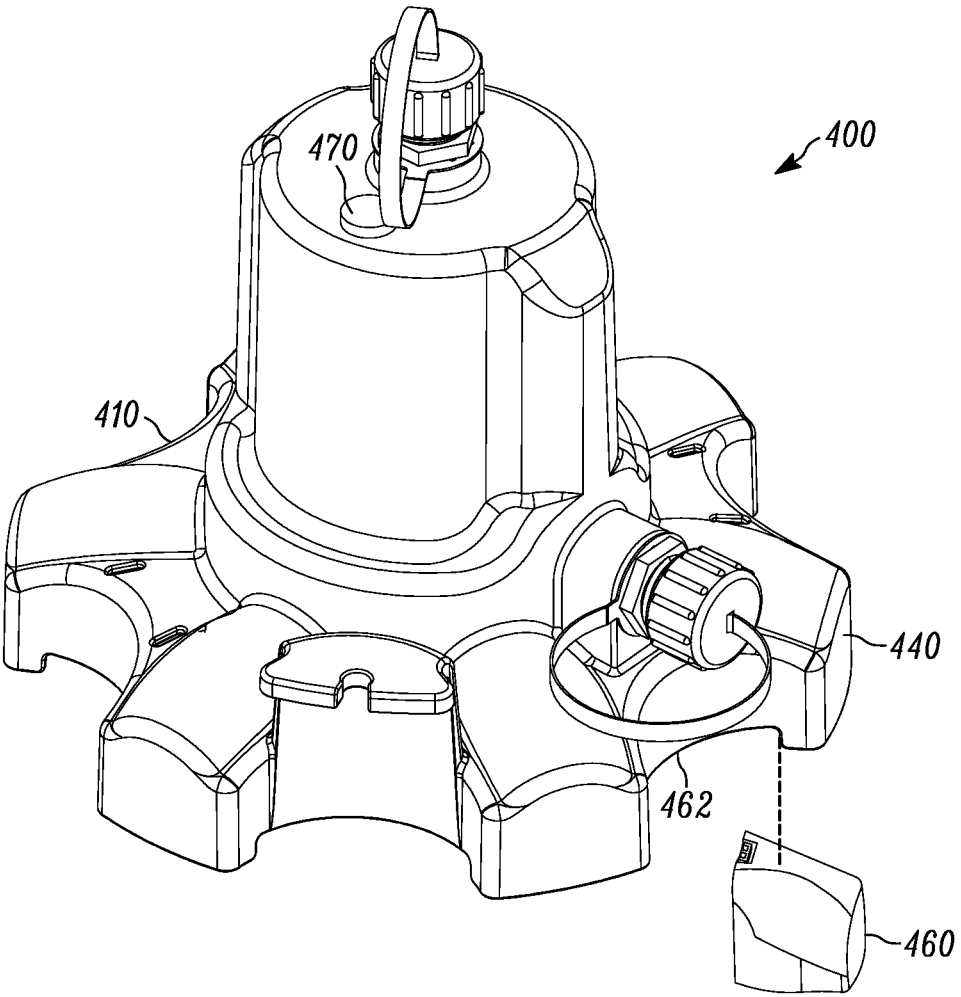
FIGS. 4A and 4B are a perspective views of an example of a pump utilizing a rechargeable and/or replaceable battery as a power source.
Figure 4B:
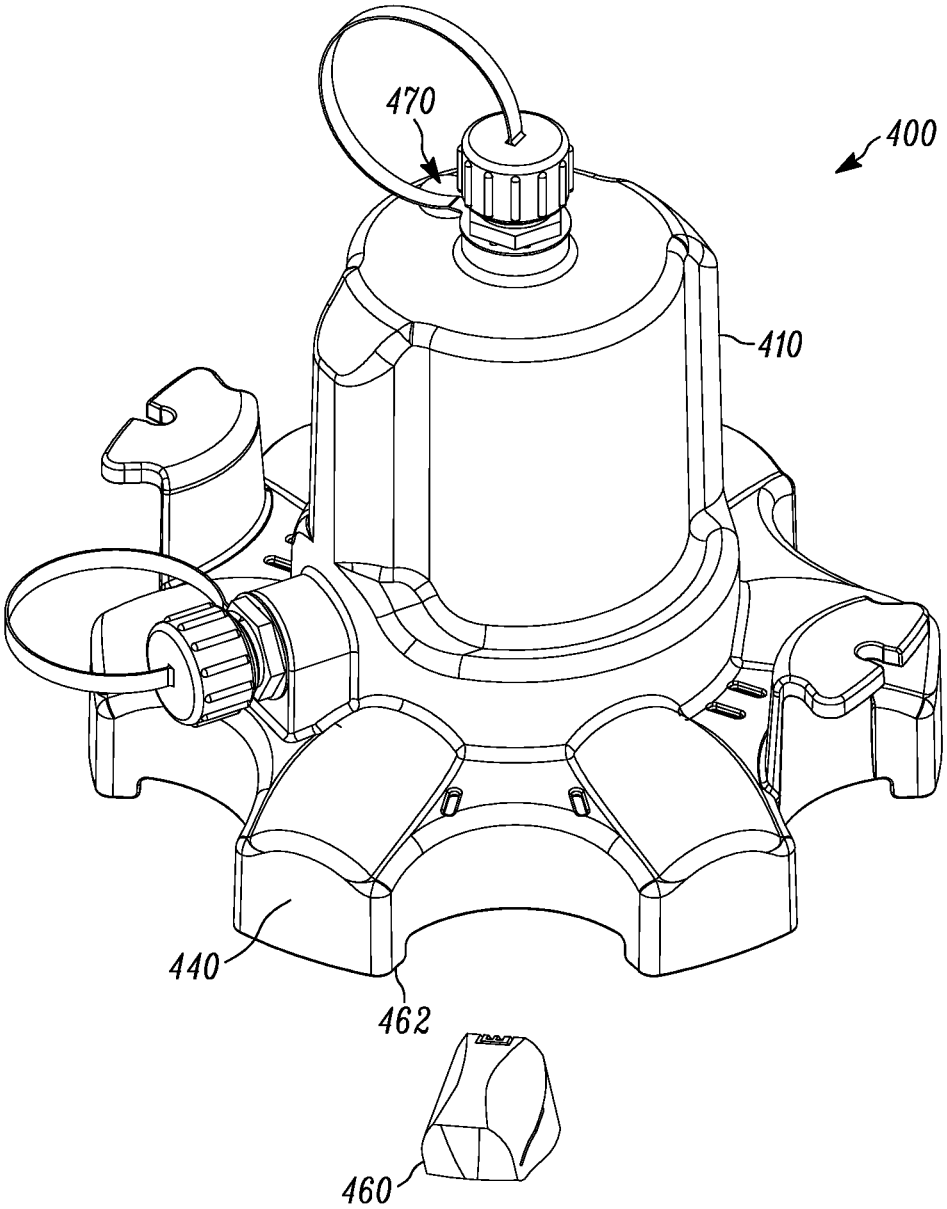
Figure 4C:
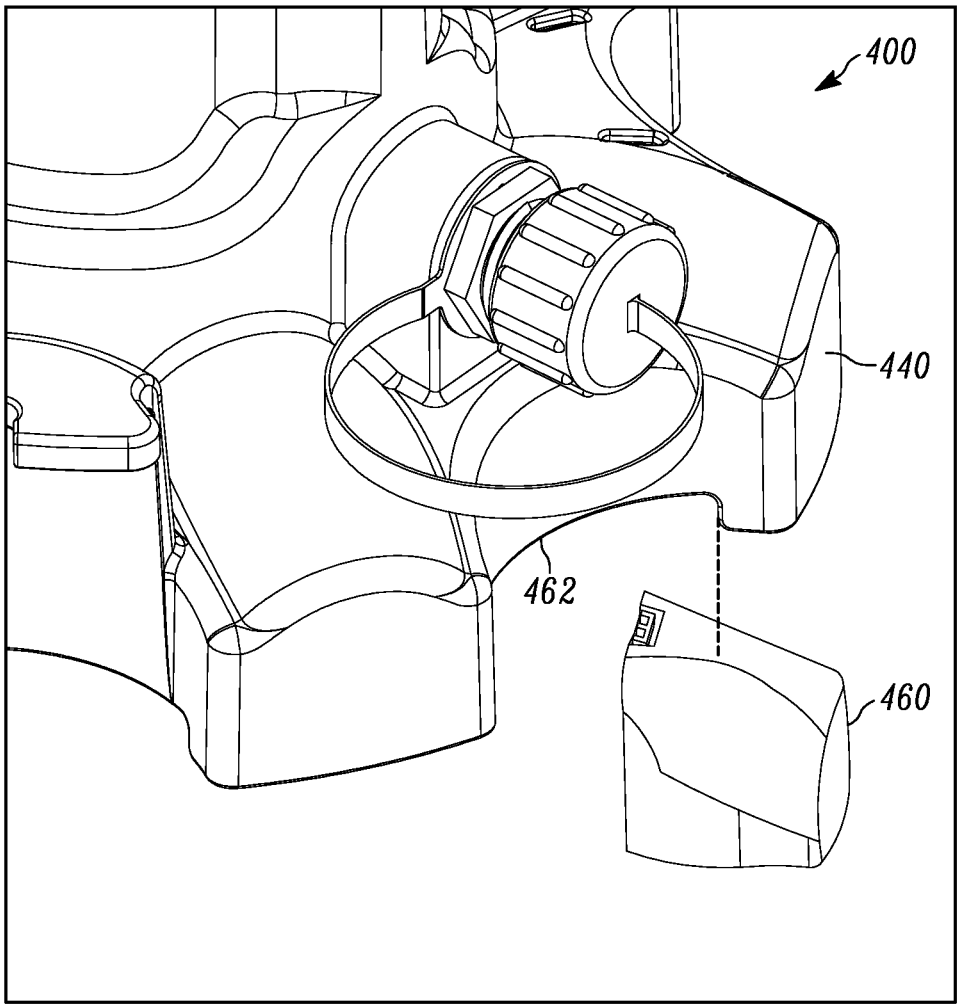
FIGS. 4C and 4D are close up views of the replaceable battery of FIGS. 4A and 4B.
Figure 4D:
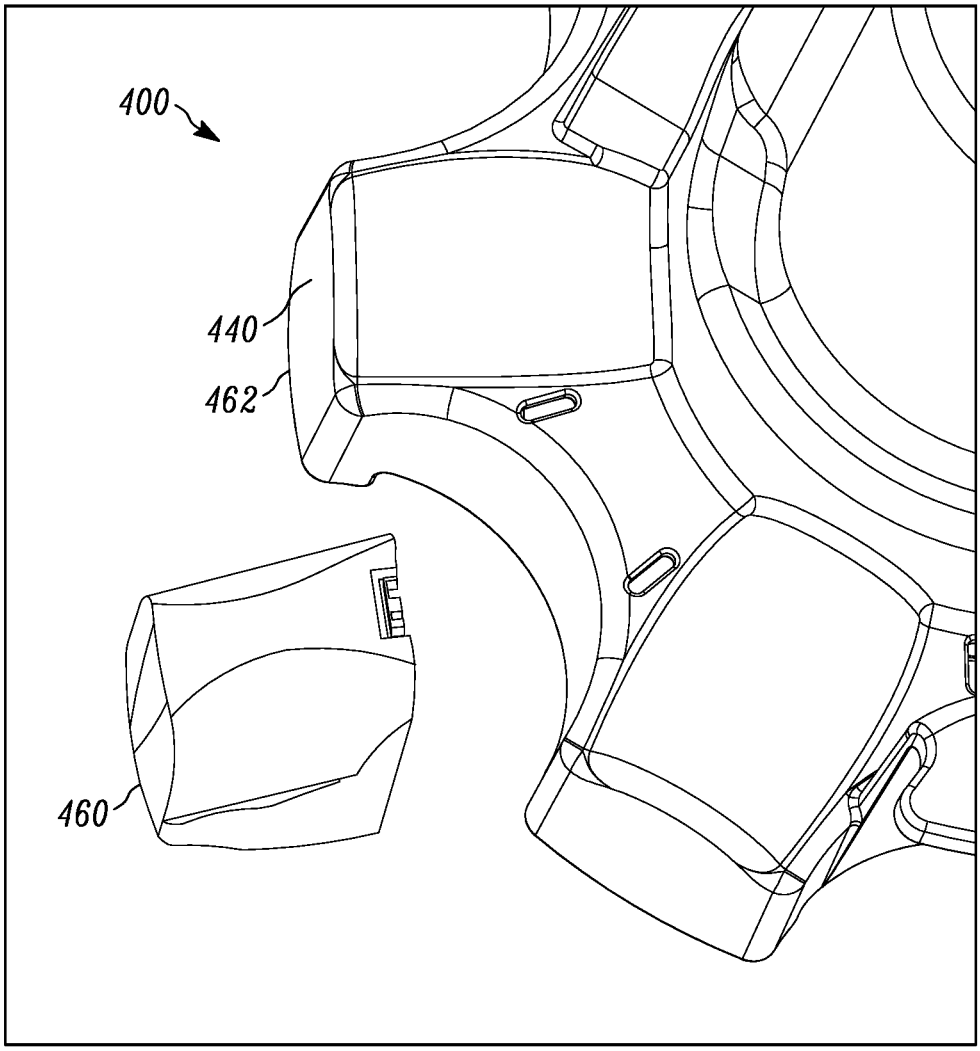

In some embodiments, a battery/battery pack provides DC power as shown in FIGS. 4A-D. FIGS. 4A and 4B show an example of a pump 400 utilizing a replaceable battery 460 as a power source. FIGS. 4C and 4D are close up views of the replaceable battery 460. The battery 460 attaches to a corresponding power input source 462 on the underside of the housing 410 of the pump 400. In some examples, the battery 460 is of a size to fit within foot member 440 of the pump housing 410. In some forms, the battery can be charged without removing it from the housing by simply plugging in a DC charging cord to a port electrically connected to the battery on one end and to an AC or DC power source on the opposite end. In other forms, the battery pack can be removable and/or rechargeable, such as by way of removing the battery from the pump 400 and connecting it to a charger for charging it from either an AC power source (e.g., a conventional wall outlet) or a DC power source (e.g., car 12V outlet, USB port, etc.).

The battery pack can be removable and/or rechargeable. In some examples, the battery 460 can be recharged via a docking station. In other examples, the battery 460 is rechargeable via a power cord that plugs into the housing. The battery-operated pump can be configured to turn on and off via a switch 470 (e.g., a push-button switch) located on the exterior of the pump housing 410 or at the switch plug 903. The switch 470 could include a number of types of activators or switches, including for example, on/off switches (e.g., slide switches, rocker switches, switch nobs, push-button switches, etc.), tilt switches such as float switches, pressure or pneumatic switches, capacitive sensor switches, etc. In still other examples, the battery-operated pump 400 could also be set up to automatically start upon detection of the presence of water (e.g., such as by use of a capacitive switch). Additionally and/or alternatively, the pump 400 may include a timer that automatically controls the operation (e.g., the turning on or off) of the pump. The timer can be set so that the pump automatically turns off after being on for a predetermined period of time (e.g., 30 minutes, 1 hour, 2 hours, etc.) so as not to drain (or consume) more power than necessary. The pump 400 may also be equipped with a sensor to automatically shut the pump off when it determines that it is no longer pumping fluid. The switch 470 (or timer or sensor) is not limited to use on a battery-operated pump, and could also be employed on other pumps, including pumps designed to be powered from an AC or DC power source. The switch 470 or timer could also be located away from the pump housing 410. For example, the switch 470 or timer could be located on a power cord that supplies power to the pump 400. Moreover, the power cord could also include a receiver or transceiver (e.g., a radio frequency transceiver) that allows for the remote control of the pump 400.

Figure 2:
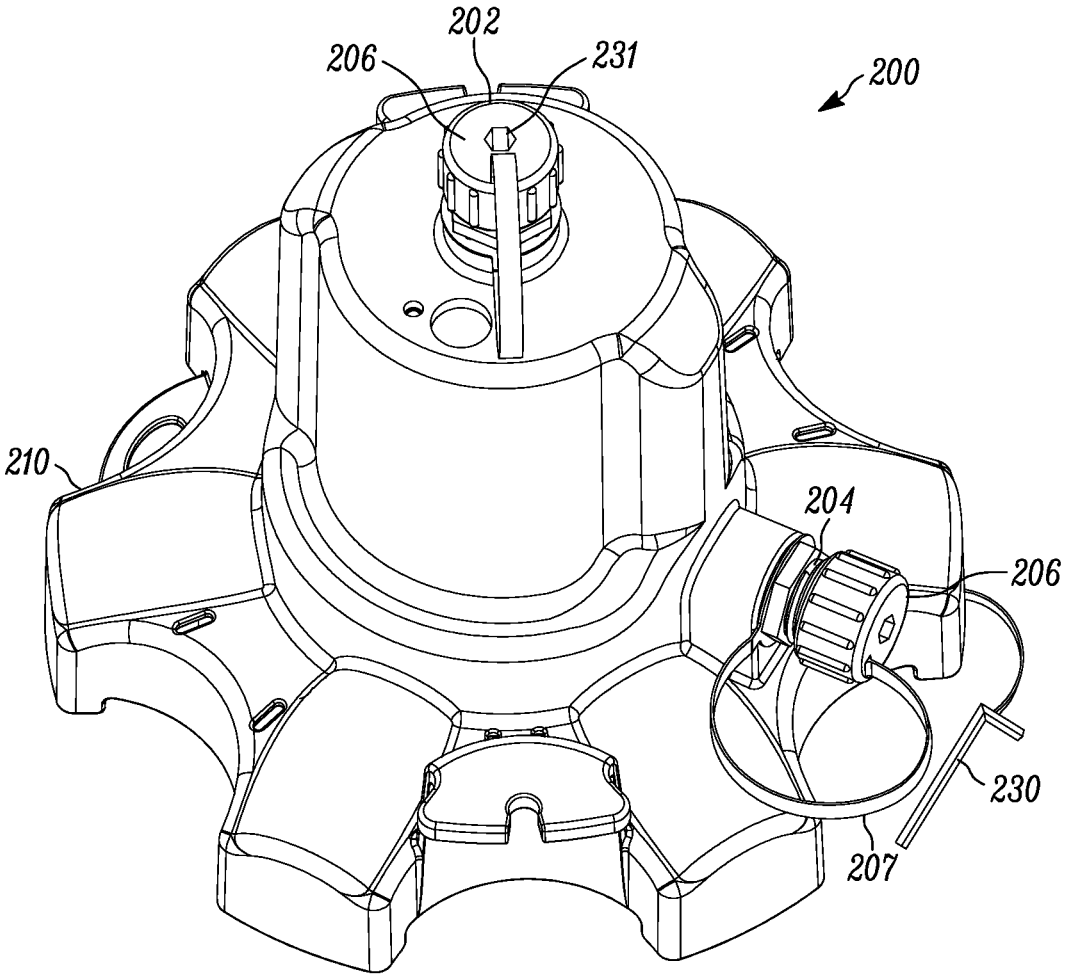
FIG. 2 shows a perspective view of an alternate pump in accordance with other embodiments of the invention illustrating sealant mechanisms such as threaded caps on the discharge outlets to seal the outlets.

Some examples of the pump have a fluid inlet 150 for drawing fluid into the pump housing 110, and a first discharge outlet 102 for discharging fluid out of the pump housing. The first discharge outlet 102 is adapted to attach to a fluid conduit device. In some examples, the first discharge outlet 102 is positioned on a top portion of the pump 100. The pump 100 also has a first sealing mechanism that seals the first discharge outlet 102 to inhibit discharge of fluid from the first discharge outlet 102 when not in use. The first sealing mechanism can include, for example, a threaded cap 206 (which can be tethered to the pump as shown in FIG. 2 via tether 207), or a quick-release fitting 108. The pump 100 also includes a first internal fluid flow path 114 between the fluid inlet and the first discharge outlet.

In some examples, the sealing mechanism may include, or be a part of a system that allows a user to selectively seal one or more of the discharge outlets. For example, the sealing mechanism may include a device built in to one or more of the discharge outlets that is in communication with a switch (e.g., a mechanical or electrical switch) or other controller (e.g., a computer or processor). In this way, a user can select to seal or unseal a discharge port by activating/deactivating the corresponding switch. In some examples, switch or other controller, may be accessible remotely or wirelessly so that the sealing mechanism, as well as other features of the multi-use pump, could be operated at a remote distance. For example, the switches can be configured to communicate with a remote controller device, which can be a radio, infrared, Wi-Fi, Bluetooth, or other type of signal transmitter.

The pump comprises a second discharge outlet 104 for discharging fluid out of the pump housing. In some examples, the second discharge outlet 104 is positioned on the side of the pump 100. The second discharge outlet is adapted to attach to a fluid conduit device.

A second sealing mechanism seals the second discharge outlet to inhibit discharge of fluid from the second discharge outlet when not in use. The second sealing mechanism, can also include a threaded cap 106 (which can be tethered to the pump) or a quick-release fitting 108. The pump 100 has a second internal fluid flow path 116 between the fluid inlet 150 and the second discharge outlet 104.

The threaded cap 106 has a plurality of raised ribs 106A spaced around the outer perimeter. The raised ribs 106A improve the gripability of the cap 106, aiding users in removing the cap 106 by hand. In some forms, the second discharge outlet 104 has a second cap substantially identical to the cap 106.

Referring to FIG. 2, a tool 230 (see FIG. 2) may be provided for use in securing or releasing the sealing mechanism or mechanisms as desired. For example, in one form, the pump 100 may be provided with only one sealing mechanism that is simply moved from the first discharge outlet 202 to the second discharge outlet 204 and vice versa, as needed to operate the pump in the desired manner (either side discharge or top discharge). In some examples, the sealing mechanism includes a socket 231 or other component that is designed to mate with the tool 230 to facilitate installation of the sealing mechanism. For example, where the tool 230 is an Allen wrench, the sealing mechanism may include a hexagonal shaped socket 231 designed to receive an end of the Allen wrench, so that the Allen wrench can readily tighten/loosen the sealing mechanism on or off of the outlet. In some forms, the tool 230, such as a wrench (e.g., hex key, Allen wrench, etc.), may be tethered to the sealing mechanism and used to tighten or release the sealing mechanism to the desired discharge outlet. In other forms, the pump housing 210 may define a socket or sleeve for holding such a tool.

Referring again to FIGS. 1A-E, the pump housing 110 surrounds the motorized pump, the first internal fluid flow path and the second internal fluid flow path. In some instances, the pump housing 110 may even define part of one or both of the internal fluid flow paths. In operation, the pump 100 directs fluid from the fluid inlet 150 to the first discharge 102 outlet when the second discharge outlet 104 is sealed, and directs fluid from the fluid inlet 150 to the second discharge outlet 104 when the first discharge outlet 102 is sealed.

The pump 100 may include an electrical power outlet opening 103, which can be configured to receive or otherwise mate with a power cord to provide power to the pump 100. In some examples, the opening 103 is configured to provide a water-proof connection to a water-proof power cord.

Some examples of the pump 100 include a cord-wrap mechanism 112 that facilitates winding of an electrical cord around the pump housing. In one example, the cord-wrap mechanism 112 comprises a plurality of protuberances extending from the pump housing 110. One or more of the protuberances can comprise, or operate as a handle to facilitate handling of the pump. In some forms, the handle and cord-wrap mechanism 112 are integrated into a common structure so that the protuberance forms both a handle and a portion of a cord-wrap mechanism. In still other examples, the pump 100 may have a separate handle integrated into and/or attached to the pump 100. For example, FIG. 9 shows a version of a pump 900 that includes a strap handle 975 attached to the top of the pump to help a user grab, carry, or otherwise transport the pump. The strap 975 may be made of a cloth material, leather, rubber, or other durable material. The strap 975 can form a loop to facilitate grasping with a hand or being thrown over a user's shoulder, for example. The strap 975 may be permanently affixed to the pump 900, or it may be removably attached, allowing the user to dispose of the strap if it is not desired, or if it may get in the way of a particular application. In other examples, the pump 100/900 may include other aspects that can be used as a handle, including a bar, a knob, or a recessed groove. The handle can be placed on the top, as shown in FIG. 9, or in other locations such as the side, bottom, or another location of the pump 100 that facilitates carrying and handling of the pump 100.

Some examples of the pump 100 also include a hanging apparatus 118 (see FIGS. 1C-E), or a hook that supports vertical hanging of the pumping apparatus. The hanging apparatus 118 is positioned so that the vertically hanging pumping apparatus is arranged to facilitate fluid drainage out of at least one of the discharge outlets. For example, the hanging apparatus 118 can be arranged so that, when hanging, fluid within the pump 100 drains easily out of the side discharge outlet 104. In some forms, the hanging apparatus is integrated with at least one of the handle and cord wrap mechanism to further conserve space and make more efficient use of the structural design of the pump.

In some examples, the pump 100 comprising a filter system that filters debris from the motorized pump. The filter system can include a plurality of concentric filter levels, including, for example, filter rings (122, 124, 126), and/or legs 128, each concentric filter level having a plurality of filter openings (123, 125, 127, 129), wherein the filter openings (e.g., 123) of an outer concentric filter ring (e.g., 122) are larger than the filter openings (e.g., 125, 127) of any inner concentric filter ring (124, 126) so that at least some smaller debris that can pass through an outer concentric filter ring is filtered by an inner concentric filter ring.

Figure 1C:
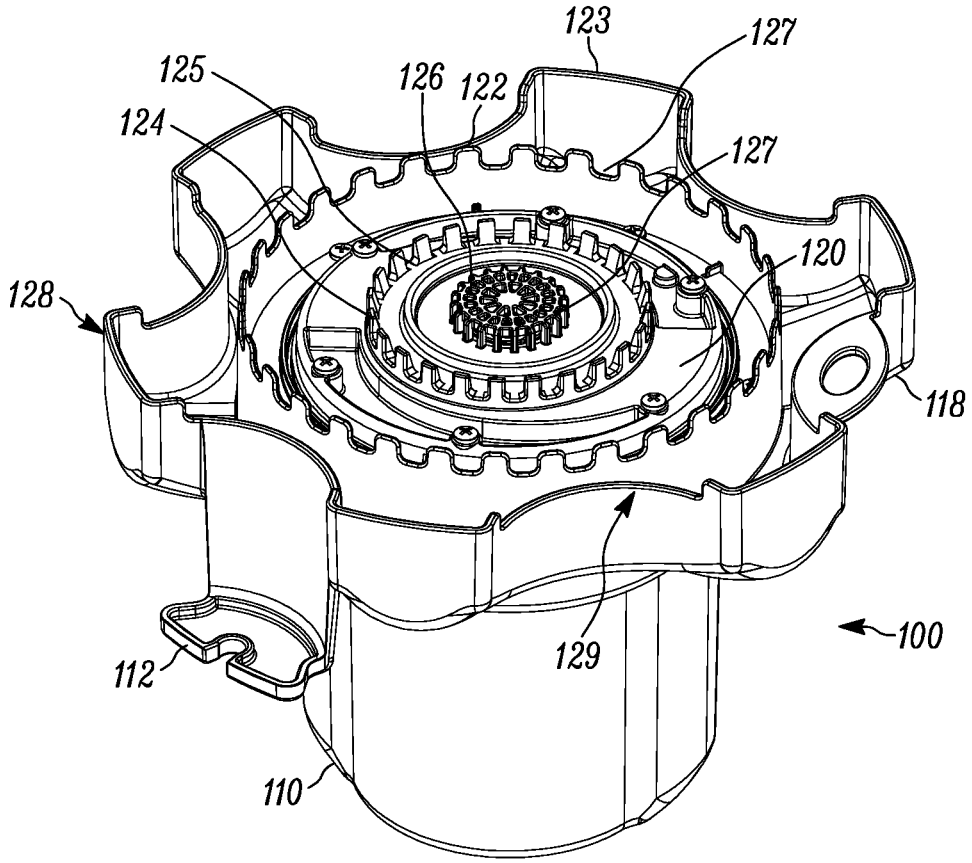
FIG. 1C is an alternate perspective view of the pump of FIG. 1A taken from below and with the pump inverted illustrating the outer housing for a fluid pumping device and the bottom portion of the housing employing a plurality of filter rings each with filter openings of varying size. The filter rings can be a part of the pump housing and a filter.
Figure 1D:
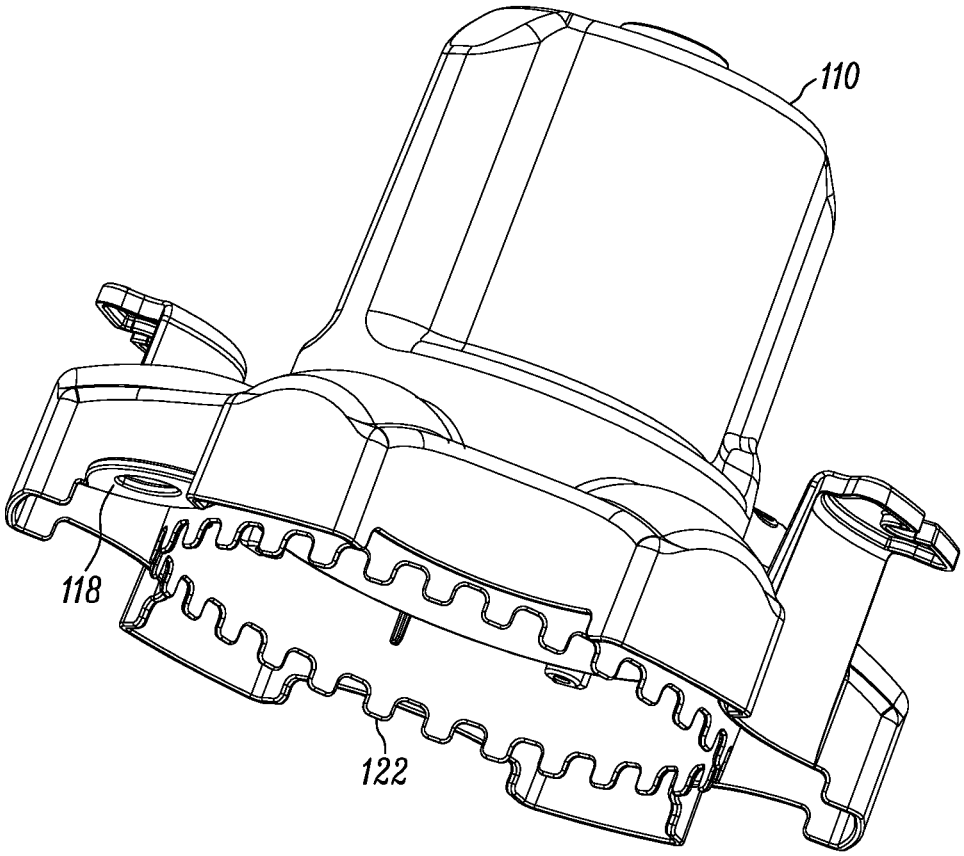
FIGS. 1D-E show perspective views from below and above, respectively, of just the housing of the pump of FIGS. 1A-C illustrating various features of the pump housing.
Figure 1E:
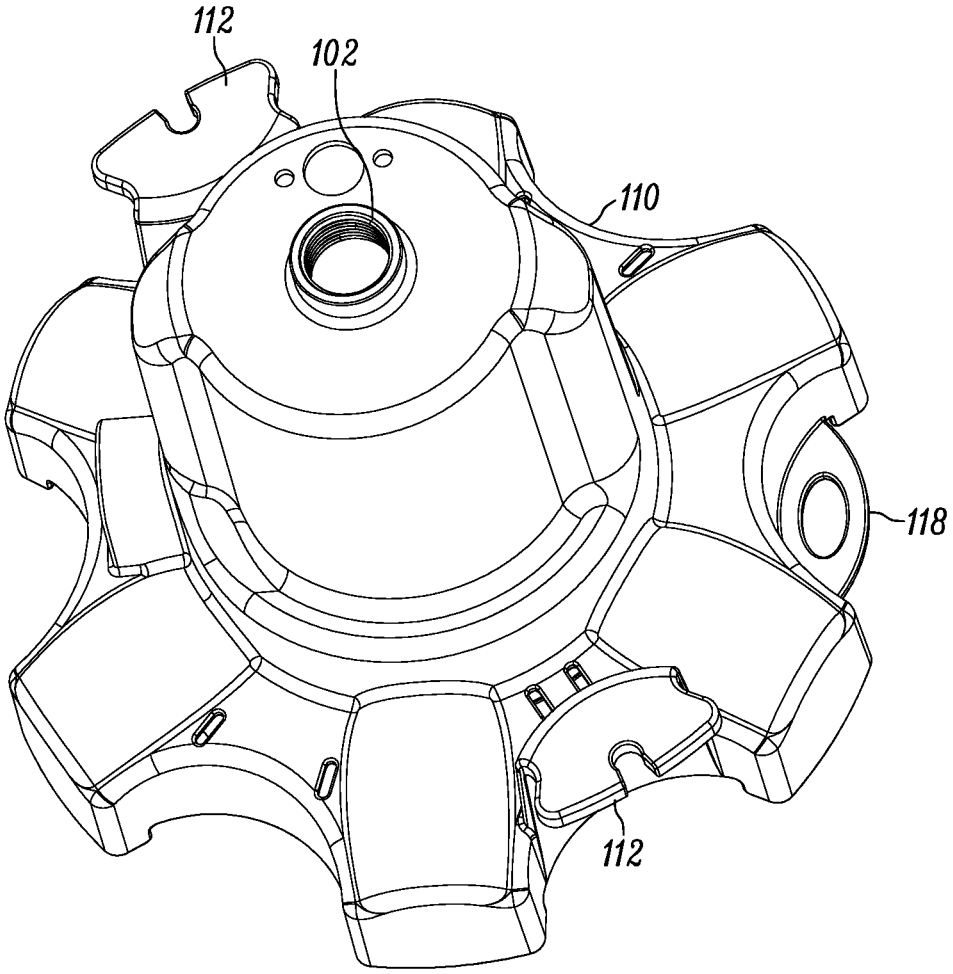

In some aspects, at least one filter ring (122, 128) is a component of the pump housing 110, as shown in FIGS. 1C and 1D. Additionally and/or alternatively, the filter system comprises a filter device 120, wherein at least one filter ring (124, 126) is a component of the filter device 120.

Figure 3:
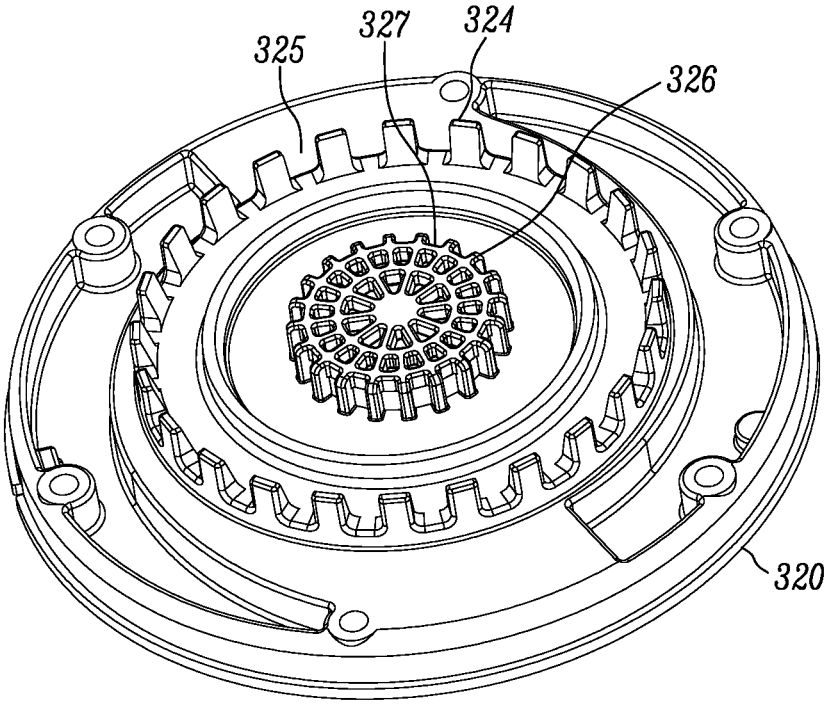
FIG. 3 shows a perspective view of the central ring filter assembly of the pump of FIGS. 1A-C illustrating various features of same.

FIG. 3 shows an example of a filter device 320 for a fluid pump. In some examples, the filter 320 includes a plurality of concentric filter rings 324, 326. Each concentric ring has a plurality of filter openings 325, 327. The filter openings 325 of an outer concentric filter ring 324 are larger than the filter openings 327 any inner concentric filter ring 326 so that at least some smaller debris that can pass through an outer concentric filter ring is filtered by an inner concentric filter ring.

Other embodiments further include a housing that is configured with a first mating structure that allows accessories to be attached or removed from the pump. For example, in one form the pump housing defines a socket within which the above mentioned tethered tool may be stored for tightening and loosening the sealing mechanism. In other forms, housing attachments or accessories, such as leg extenders or handles may be attached to either stabilize the pump or allow it to be dropped into sumps or other recessed areas more easily. In some forms, some of the above-mentioned features may also be attached to the pump with such a mating structure in order to allow the pump to be customized as desired by the user. For example, the above-mentioned cord wrap structures, handles and/or hooks could connect to the pump housing using a mating structure, such as a friction fit tongue and groove configuration. In this way, they could be moved about the pump housing to be placed in an orientation desired by the user or replaced with alternate accessories (e.g., different shaped hook receptacles, longer legs or foot members, etc.).

In some examples, the pump and/or the pump housing can include foot members 140 that support the stability of the pump. In some aspects, the foot members 140 can be adapted so that accessories such as the above-mentioned leg extensions can be connected, thereby expanding the diameter of the base of the pump 100 to provide even further stability.

Figure 8:
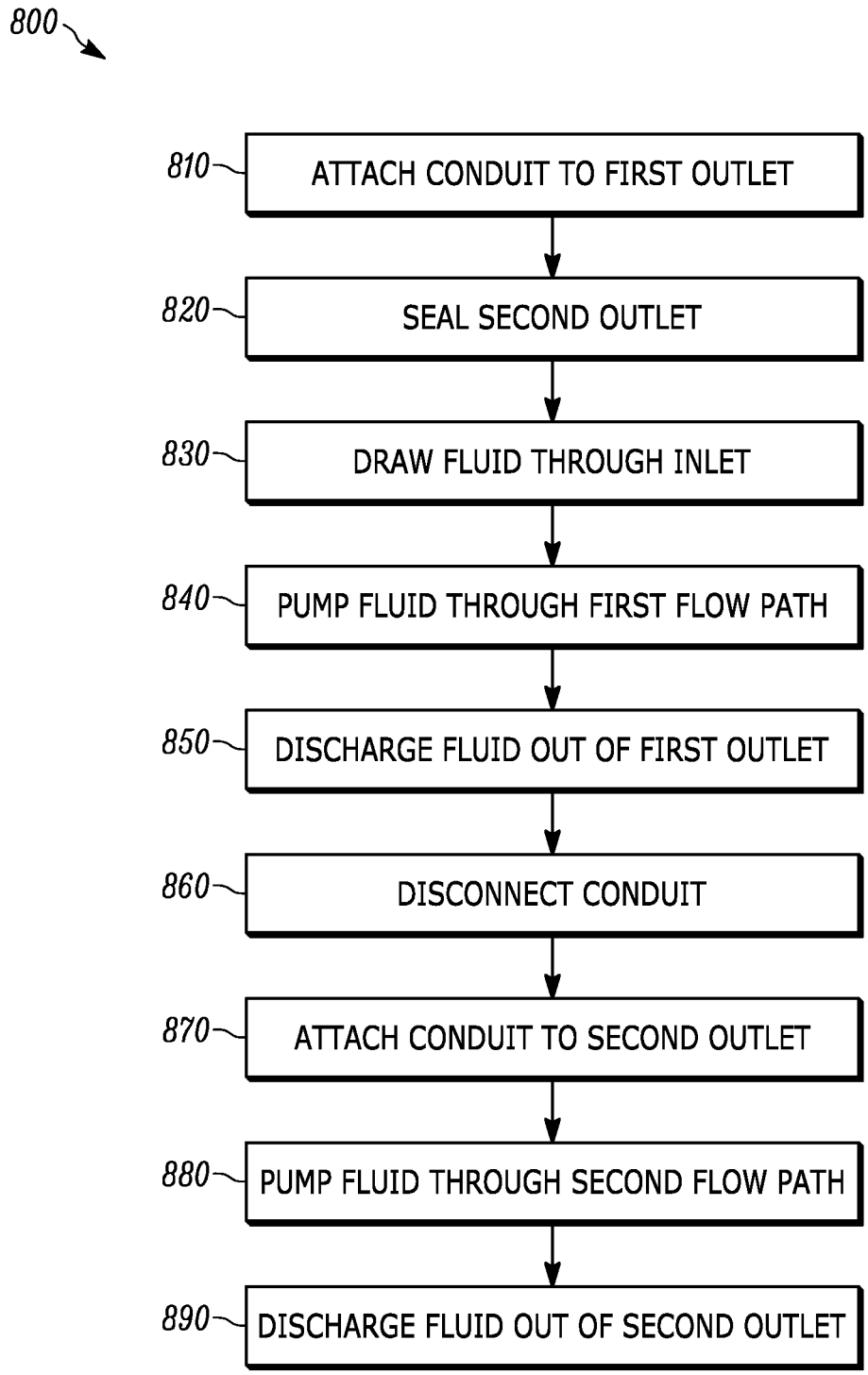
FIG. 8 is a flow diagram of an example method for pumping fluid from a pumping apparatus in accordance with aspects described herein.

The present disclosure also relates to methods of pumping fluid. In particular, the present disclosure describes examples of methods and techniques from pumping fluid in from multiple outlets in a pumping apparatus. FIG. 8 provides a flow diagram of an example of one such method 800.

The method 800 involves pumping fluid from multiple outlets in a fluid pumping apparatus, which can be any of the pumping apparatuses described herein. In some examples, the pumping apparatus has a pump and a pump housing, and two discharge outlets. Each of the discharge outlets may have a sealing mechanism that serves to seal the outlet when not in use, but to allow free flow of fluid out of the outlet when in use. In some examples, the two outlets can be placed on opposite sides of the pumping apparatus. In other examples, the outlets are placed on different sides of the apparatus so as to pump in two different (e.g., perpendicular) directions. For example, one outlet may be on the top of a pumping apparatus, and the other can be on the side of the apparatus. The pump has at least two internal flow paths in the housing that connects an inlet to each of the discharge outlets.

The method 800 can include attaching 810 a fluid conduit to a first discharge outlet. This attaching can serve to unseal the first sealing mechanism and establish a fluid connection with the conduit. In some aspects, the step of unsealing may occur prior to the attaching of the conduit. For example, unsealing the outlet may first involve removing a cap from the discharge outlet.

Using a sealing mechanism, the second discharge outlet is also sealed 820 to inhibit, obstruct and/or prevent fluid from being discharged from the second discharge outlet. Sealing can include placing a threaded cap over the second discharge outlet, or using an internal sealing mechanism (e.g., similar to a seal in a quick-release mechanism) to maintain a seal of the discharge outlet. In some examples, step 820 may not require an active step. For example, when the outlet defaults to a sealed position, step 820 may simply include maintaining the second outlet in a sealed position. In some examples, the sealing mechanism can be built into the discharge outlet and activated by way of a switch (e.g., a mechanical or electrical switch), that allows the user to select which discharge outlet to use without having to actively seal or close that specific outlet.

Next, the pump is operated 830 to draw fluid into the pump housing through the inlet. The fluid is then directed 840 from the fluid inlet, through a first internal fluid flow path in the housing, and toward the first discharge outlet. Because the second discharge outlet is sealed, fluid will not be directed toward that outlet. Fluid is then discharged 850 from the first outlet, through the conduit, as desired by the user.

Because the method 800 contemplates using multi-outlet pumps, the method 800 may further comprise additional steps that allow for the pumping of fluid out of the second port. In this manner, the method 800 may include disconnecting 860 the conduit from the first outlet, and subsequently re-sealing the first outlet. In some examples, a significant amount of time may elapse between step 850 and step 860, such that the two steps are each performed as part of separate pumping tasks. In some examples, the disconnecting 860 of the conduit may serve to automatically seal the first outlet, for example, by using a quick-connect sealing mechanism to automatically seal the first discharge outlet so that the pump will not discharge fluid from that port.

A conduit is then attached 870 to the second discharge outlet, thereby establishing a fluid connection between the second discharge outlet and the inlet. The attaching 870 of the conduit may serve to unseal the second discharge outlet itself, but in some examples, a separate step of unsealing may be necessary. For example, it may be necessary to remove a cap that was previously sealing the second discharge outlet.

In some examples, the same conduit that was previously attached to the first discharge outlet (e.g., in step 810) may be used to connect to the second discharge outlet in step 870. However, in other examples, different conduits may be used. Further, in some examples, each discharge outlet may be configured to use different types of outlets, such as outlets having different mating parts or conduit diameters.

Fluid is then pumped 880 into the inlet and through the second flow path toward the second discharge outlet. The fluid is then discharged out of the second outlet 890, through the conduit. In this way, the pump can be used to discharge fluid from different outlets. In some examples, wherein the fluid discharged from the second discharge outlet (e.g., in step 890) is discharged in a direction perpendicular to the direction of fluid discharged from the first port (e.g., in step 850). In other examples, for example, where the discharge ports are arranged on opposite ends, the discharge directions can be parallel to one another.

It should be noted that the example described above involves attaching a conduit to the discharge outlets prior to fluid being discharged therethrough. However, not all embodiments will require the connection of a conduit, as fluid may simply be projected away from the outlet. In this manner, the discharge outlet may utilize a switch, lever, or other technique to maintain the outlet sealing mechanism in an unsealed position.

Moreover, some embodiments can determine which of the multiple outlets to discharge fluid based on other techniques that are not based on which outlet has a conduit attached. For example, it may be possible in some embodiments to have conduits connected to all outlets, without rendering those discharge outlets functional or active. For example, the pump may include a selector mechanism that, in addition to the caps and connection mechanisms described above, could further include a switch, a lever, a toggle, a valve, an actuator, or another selector device that determines (or allows a user to determine) which of the discharge outlets will discharge fluid during operation of the pump, even if all outlets are attached to a conduit. For example, the selection mechanism could include a valve that opens and/or closes one or more of the internal flow paths of the pump that directs fluid from the inlet to each of the various discharge outlets.

In this way, methods for controlling a multi-flow pump may include providing a pump having an inlet, and at least a first outlet, a second outlet. The provided multi-flow pump would also have a mechanism for selecting which of the first outlet and second outlet fluid will through. The method further includes moving the mechanism between a first position for allowing fluid to flow through the first outlet and a second position for allowing fluid to flow through the second position. For example, the method may include utilizing a first outlet obstruction and a second outlet obstruction in the pump. The obstructions may be placed in the internal fluid flow paths of within the pump housing. The method may involve moving the mechanism between the first position and second position comprises, respectively, such that the second outlet obstruction engages with the second outlet to obstruct the second outlet and prevent fluid from flowing through the second outlet when the mechanism is in the first position. Further, the method can include moving the first outlet obstruction into engagement with the first outlet to obstruct the first outlet and prevent fluid from flowing through the first outlet when the mechanism is in the second position.

The moving of the mechanism can be performed manually by a user, such as by sliding a lever or pressing toggle mechanism, or the moving could be performed automatically and/or electronically, such as by a controller or computer operated device. For example, the controller can be configured to automatically move a lever, valve, actuator, obstruction device, or the like in response to receiving a signal or command. Additionally and/or alternatively, the controller may effect movement of the mechanism in response to making a determination to change the discharge flow outlets. Such a determination could be based on a variety of factors or combinations of factors, such as the detection (using sensors) of the amount of flow into and/or out of the pump, a detection of the amount of time (using a timer) that monitors how long the pump is operating, and/or algorithms that monitor pumping features such as pumping speed, power, efficiency, flow rate, flow volume, etc.

Additionally and/or alternatively, the pump could be configured so that some or all of the outlets are capable of discharging fluid even if there is no conduit attached thereto. In some situations, the pump can be configured so that more than one of the pump outlets discharge fluid simultaneously, regardless of whether or not a conduit is attached thereto.

The present figures show pumps with dual outlets for purposes of simplicity of description. It should be understood that the described technology could include three or more outlets, depending on the size, shape, and construction of the pump. In any case, the pump will have the ability to pump from one outlet, or a selection of multiple outlets, among all of the outlets on the pump itself. For example, pumps may include three, four, or even five discharge outlets, and can be configured so that only one of the outlet discharges fluid during operation, so that some of the outlets discharge fluid during operation, or so that all of the outlets are discharging fluid during operation.

Figure 10:
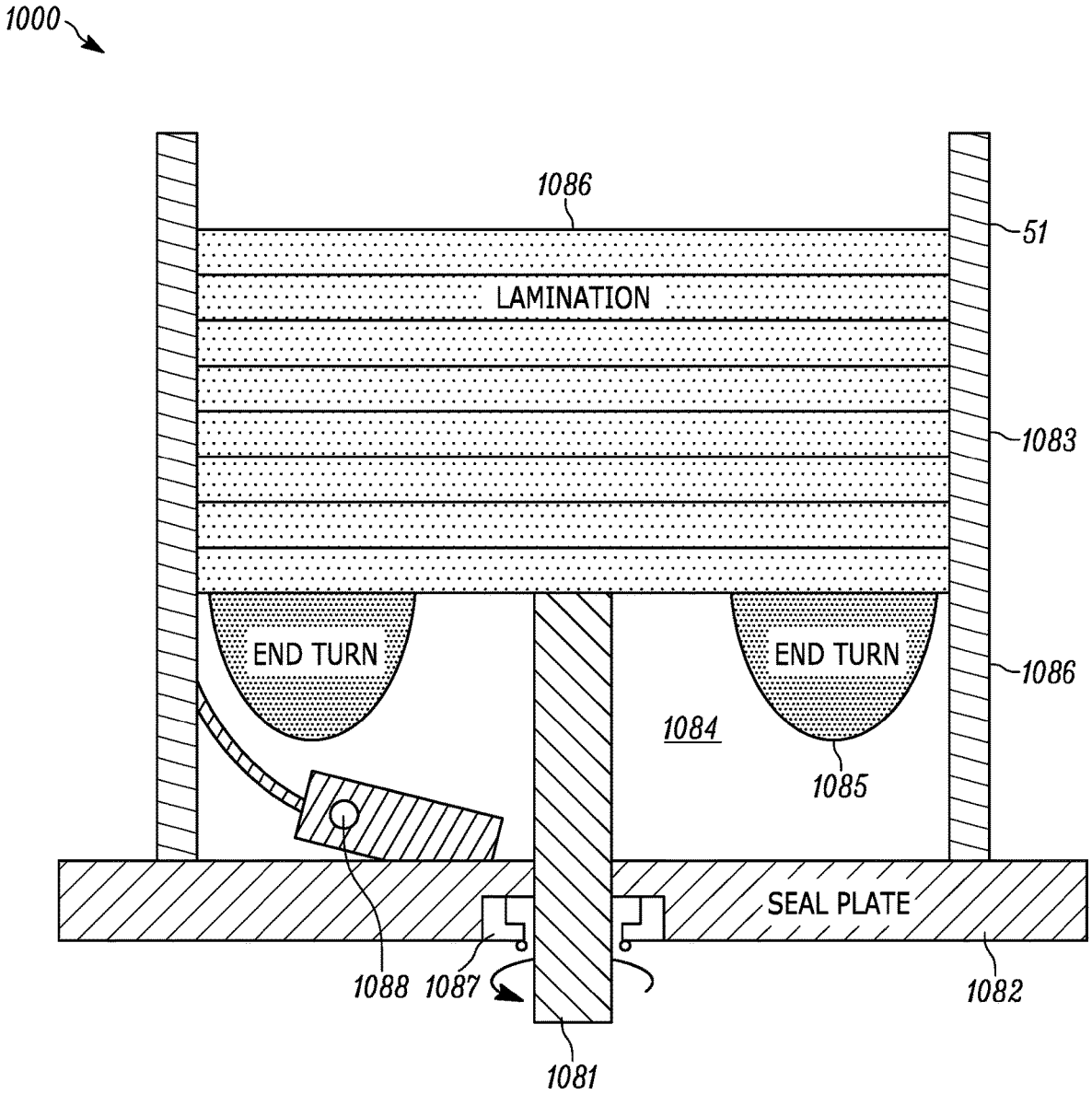
FIG. 10 is a cross sectional view of a motor housing of a utility pump.

Turning to FIG. 10, the pump 1000 includes a motor housing 1080. The motor housing 1080 is a sealed body to isolate the electric motor from the fluid in which the pump 1000 is submerged. The motor housing 1080 comprises a generally cylindrical sidewall 1083. At the bottom of the sidewall 1083 is a seal plate 1082 through which the motor shaft 1081 extends. The seal plate 1082 is sealed to the sidewall 1083 and the shaft 1081 so as to isolate the cavity 1084 from the exterior of the pump 1000. A lip seal or mechanical seal 1087 extends around the motor shaft 1081 to aid in the isolation of the cavity 1084.

The cavity 1084 houses the rotors 1085 of the pump 1000. The rotors 1085 are positioned proximate the stator laminations 1086. In operation, when a current is applied to the motor, the rotor 1085 rotates relative to the stator laminations 1086, this rotation is transferred to the shaft 1081 which in turn drives the impeller of the pump 1000.

In some forms, the cavity 1084 is full of an electrically insulating or dielectric fluid, such as dielectric oil. The fluid improves heat transfer so as to aid in cooling the motor. In operation, the motor generates heat when operating, the heat dissipates through the fluid and is transferred through the seal plate 1082 and/or the sidewall 1083 to the surrounding area. When the pump 1000 is pumping liquid, such as water, the liquid is directed to flow proximate the seal plate 1082 and/or sidewall 1083 to cool the motor. When the pump 1000 is running, but no liquid is being pumped, the pump 1000 may generate heat faster than it dissipates and overheat.

A self-locking thermal cutoff ("TCO") 1088 is located in the cavity 1084 proximate the rotor 1085, stator laminations 1086, and/or seal plate 1082. The TCO 1088 controls power to the motor. When the motor reaches a predetermined temperature, the TCO 1088 opens the power circuit, cutting power to the motor. The TCO 1088 is self-locking, such that after cutting power to the motor, the TCO 1088 must be manually reset in order for the motor to be powered again. In one form, the TCO 1088 is coupled to a switch or button which can be actuated by the user in order to reset the TCO 1088. In alternative forms, the TCO 1088 is coupled to the power supply or power switch such that toggling the power switch and/or cutting power to the pump (such as by unplugging it) resets the TCO 1088.

A TCO 1088 can be made self-locking in multiple ways. In one exemplary embodiment, the TCO 1088 powers a coil that when powered holds a spring biased switch in an open state. When the TCO 1088 reaches the target temperature, power to the coil is cut, the spring closes the switch, and the switch connects a heater to the power supply. The heater then maintains the temperature of the TCO at or above the target temperature. Alternatively, the TCO 1088 powers a coil holding a spring biased switch or relay in a closed state. The current provided by the TCO 1088 is sufficient to hold the relay closed, but not to overcome the spring to switch it from open to closed. When the TCO 1088 reaches the target temperature, the power to the relay is cutoff and the switch opens until it is manually closed. In this form, the relay controls power to the motor. In still further examples, the TCO 1088 outputs a signal to a microcontroller. When the microcontroller detects that the TCO 1088 has stopped transmitting a signal and/or when the microcontroller receives a signal indicating the target temperature has been reached, the microcontroller controls a switch to cutoff power to the TCO 1088 and/or the electric motor.

Figure 11:
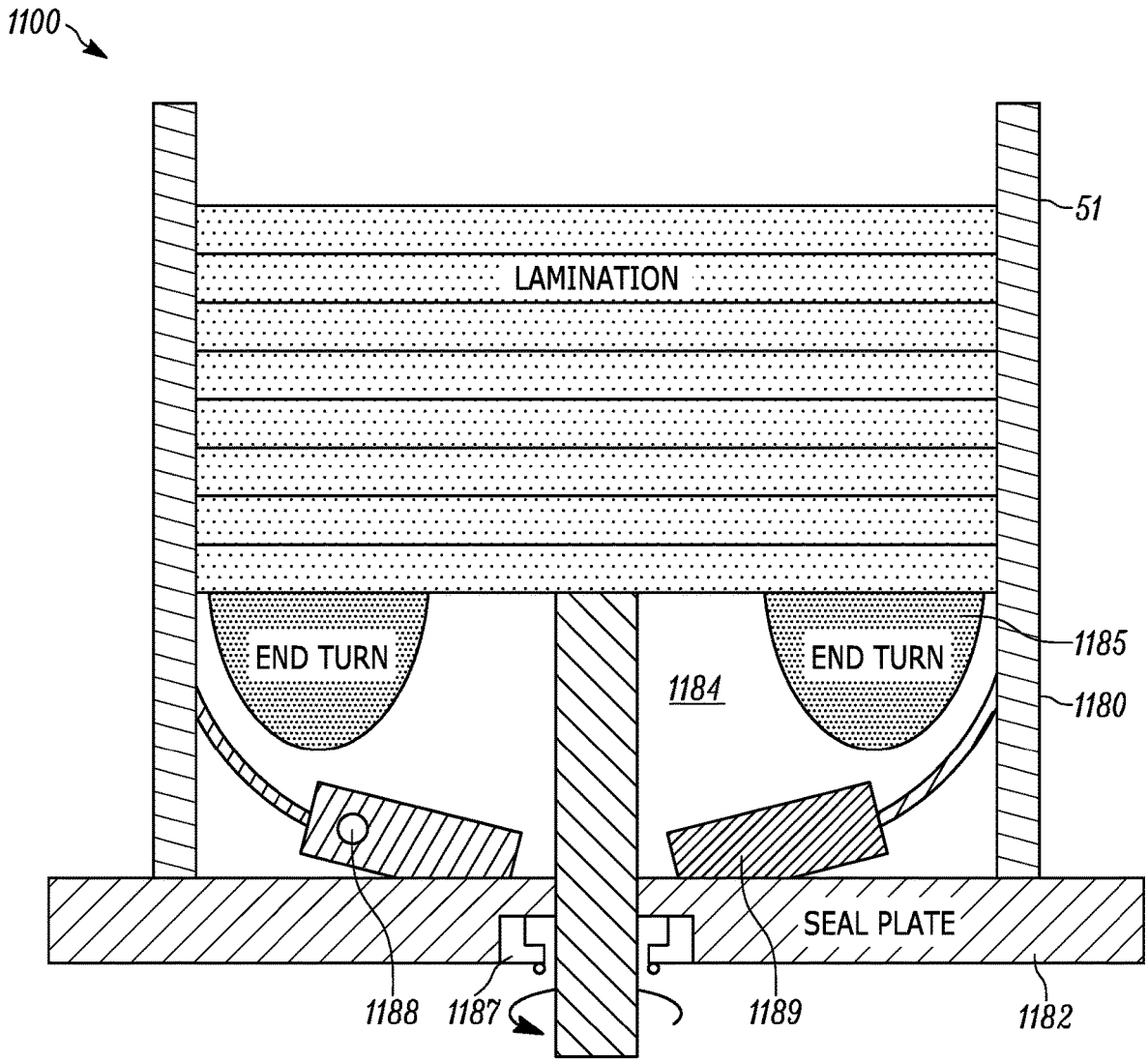
FIG. 11 is a cross sectional view of a motor housing of an alternate pump.

Turning to FIG. 11, the pump 1100 is substantially similar to the pump 1000 except for the addition of a second TCO 1189. The TCO 1189 is not self-locking. The TCO 1189 is configured to cut power to the motor when a predetermined temperature is reached. In a preferred form, the predetermined temperature of the TCO 1189 is equal to or greater than the predetermined temperature of the self-locking TCO 1188. The TCO 1189 serves as a safety to prevent the motor from overheating to a temperature sufficient to damage the pump 1100 and/or the surrounding area. Whereas the self-locking TCO 1188 serves as a control switch to determine by temperature when the pump 1000/1100 is no longer pumping liquid, and turning off the pump 1000/1100.

In operation, the pumps 1000/1100 are submerged into liquid, such as water. The pump motor is powered, such as by turning on the power switch or by plugging in the pump to an electrical outlet. Under standard conditions, the pump continues to pump liquid, until all of the liquid into which the pump is submerged has been discharged. Once the inlet of the pump stops pulling in liquid, the temperature of the motor begins to rise. When the target temperature is reached, the self-locking TCO 1188 cuts power to the pump motor.

Figure 12:
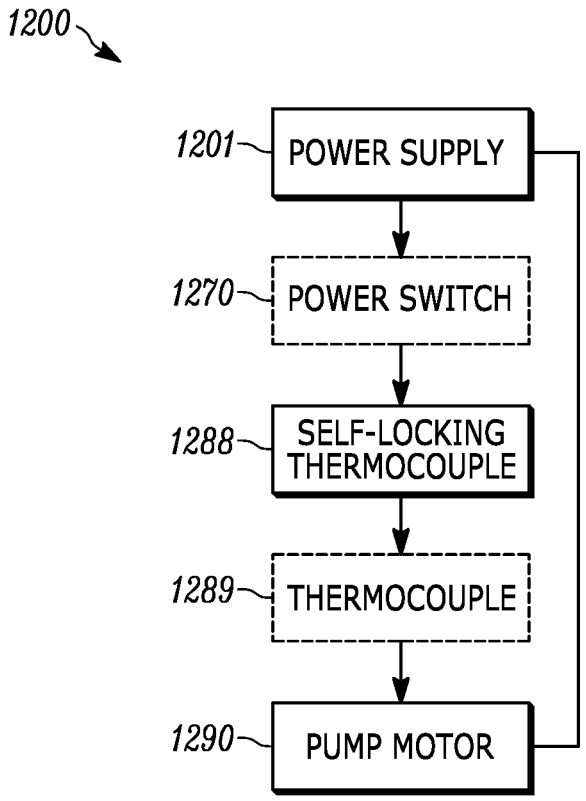
FIG. 12 is a block diagram illustrating a power circuit for a pump.

FIG. 12 illustrates a block diagram 1200 of the power circuitry of a pump, such as the pumps 1000/1100. The pump includes a power supply 1201. The power supply 1201 may include the power supply of the building by way of an electrical plug or direct wiring. Alternatively or additionally, the power supply 1201 includes a battery backup and/or a generator. The power supply 1201 is connected to the pump motor 1290 by one or more switches 1270/1288/1289. The switches include a power switch 1270, a self-locking TCO 1288, and a TCO 1289. The power switch 1270 is a switch operated by the user, such as the switch 470 described above. The self-locking TCO 1288 is a thermal control for the pump that turns off the pump when a target temperature is reached. The target temperature is predetermined to be a temperature above the temperature reached by the pump when pumping liquid in standard conditions, but below a critical temperature at which a heightened risk of damage to the pump and/or the surrounding area as a result of high temperature exists. The TCO 1289 is a safety TCO configured to temporarily cut power to the pump motor 1290 whenever the temperature of the motor is above a predetermined target temperature. The TCO 1289 automatically closes when the temperatures of the pump fall below the target temperature.

Figure 13:
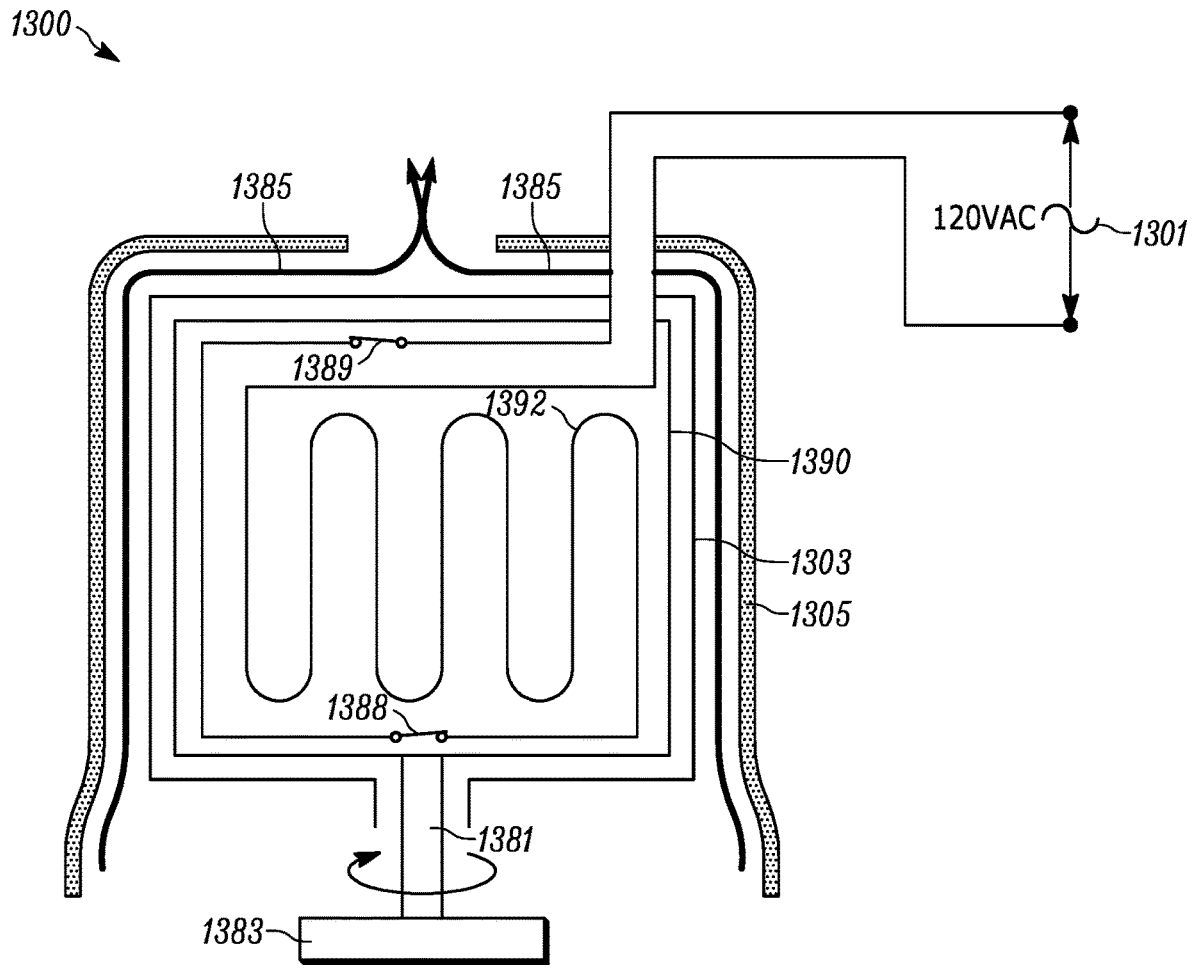
FIG. 13 is a schematic illustrating a power circuit for a pump.

FIG. 13 illustrates a schematic illustrating a pump 1300 having a self-locking TCO 1388 and a non-locking TCO 1389. Such a configuration may be desirable to prevent the pump 1300 from re-activating or turning on once the TCO has dropped below its activation temperature. For example, it may be desirable to keep the pump off after the TCO 1389 has been triggered to stop pump operation due to excess heat so that the pump user or operator knows that this event (e.g., the high temperature situation that triggered the TCO 1389) has occurred and/or to prevent the pump from repeatedly turning on and off based on a repeating situation that causes pump temperature rises. Thus, with this dual TCO configuration, the pump will remain off until the pump user or operator has reactivated the pump by some means (e.g., unplugging the pump and re-plugging it in, activating an actuator to restart or reset the pump, etc.). Such a feature will help prevent the pump from damaging itself, such as due to dry running of the pump, repeated on/off actuation of the pump if repeated temperature cutoffs are hit, attempted running when the impeller is jammed, etc.

Figure 14:
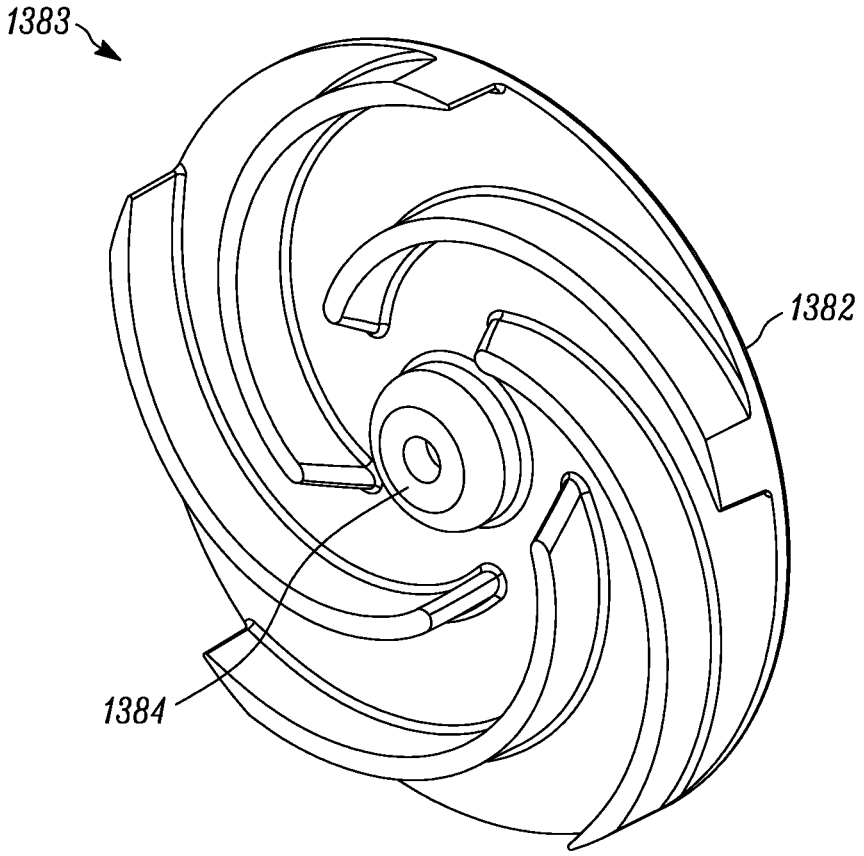
FIG. 14 is a perspective view of an open impeller.

In the embodiment illustrated in FIG. 13, the pump 1300 has a power supply 1301. In some forms the power supply 1301 is a standard outlet providing 120 volt alternating current power (e.g., mains power). However, as mentioned above, in alternate embodiments the pump 1300 may be battery powered. The power source 1301 powers the motor 1390. Power from the power source 1390 flows through windings 1392 of the motor creating a magnetic field that causes the shaft 1381 to rotate. The shaft 1381 drives an impeller 1383 configured to induce flow in a liquid in which the pump 1300 is submerged. The induced flow pushes fluid along the flow paths 1385 defined by the inner housing 1303 and outer housing 1305 of the pump 1300. The at least a portion of the flow paths 1385 extend proximate the motor 1390. Fluid being pumped along the flow paths 1385 cool the motor. The impeller 1383 is an open centrifugal impeller as shown in FIG. 14 and described below.

With respect to the illustrated pump 1300, the TCOs 1388, 1389 are wired in series with each other and with the motor windings 1392. The TCOs 1388, 1389 are each configured to interrupt the flow of power, or enter an open state, when they exceed a predetermined temperature. The self-locking TCO 1388 transitions to an open state from a closed state when a first predetermined temperature is reached. The self-locking TCO 1388 remains in an open state until manually actuated to a closed state. As described above, the self-locking TCO 1388 can be closed, or unlocked, by cutting power to the TCO 1388, such as by temporarily unplugging the pump 1300. Alternatively, the pump 1300 may include an actuator, such as a switch or a button, configured to unlock the self-locking TCO 1388.

The non-locking TCO 1389 enters an open state when a second predetermined temperature is reached. The second predetermined temperature is higher than first predetermined temperature. The non-locking TCO 1389 closes when the temperature of the TCO 1389 drops below the second predetermined temperature.

In operation, the pump 1300 is at least partially submerged in a fluid, such as water. The pump 1300 is connected to the power source 1301, causing the impeller 1383 to pump the fluid along the flow paths 1385. The fluid cools the motor 1390. When the fluid is completely pumped away, the motor 1390 will heat up. When the first predetermined temperature is reached, the pump 1300 will be turned off until the self-locking TCO 1388 is manually reset. In theory, the non-locking TCO 1389 may never be actuated or triggered since the self-locking TCO 1388 should always be triggered/activated first or prior to the non-locking TCO 1389 being triggered/activated. However, if the self-locking TCO 1388 fails closed, the non-locking TCO 1389 will open and power off the pump 1300 whenever the second predetermined temperature is reached. The second predetermined temperature is configured to be below a temperature at which the pump 1300 is permanently damaged by overheating. This configuration affords the pump 1300 a form of redundancy or redundant protection to help protect the pump 1300 and its operation. This configuration also prevents the pump 1300 from cycling on and off over and over based on temperatures going above and below the self-locking TCO's temperature triggering threshold. The reason for this is the self-locking TCO's heater prevents the self-locking TCO from dropping below the threshold temperature until the pump is reset (e.g., unplugged, a reset switch is activated, etc.). In this way, when the pump 1300 removes the fluid it is pumping, the pump will turn off because the resulting heat increase associated with a pump that runs out of fluid to pump will trigger the self-locking TCO 1388 and shut off the pump. Unlike conventional pumps, however, the self-locking nature of TCO 1388 will keep the pump off and prevent it from turning back on once the temperature drops and, thus, prevent it from cycling on and off over and over. This allows a user to activate the pump and walk away without having to worry about when the pump is through pumping fluid as the pump will not re-activate without the user taking some affirmative action on the pump (e.g., unplugging the pump and plugging it back in, actuating a reset switch, etc.). Thus, in one form, a fluid pumping apparatus is provided that includes a pump housing, a motorized pump, an electrical power supply supplying electrical power to the motorized pump, a self-locking thermal cutoff configured to control the connection between the motorized pump and the power supply, wherein the self-locking thermal cutoff interrupts or disconnects the motorized pump from the power supply when a temperature of the motorized pump exceeds a predetermined temperature and includes a heater for maintaining the thermal cutoff at or above its triggered temperature to keep the pumping apparatus off until it is reset.

FIG. 14 is a perspective view of the open centrifugal impeller 1383. The impeller 1383 includes a hub 1384 configured to detachably couple to the shaft 1381 and a plurality of vanes 1382 configured to induce flow when the impeller 1383 is rotated. The vanes 1382 draw fluid upward through a bottom inlet in the pump housing or volute (such as openings 326, 327 described above). The vanes 1382 then push the fluid radially outward into the flow paths 1385.

The vanes 1382 are uncovered along the bottom edges thereof. In other words, the impeller 1383 is an open impeller. The open design reduces the likelihood of clogging when the pump 1300 is submerged in fluid containing debris.

Figure 15A:
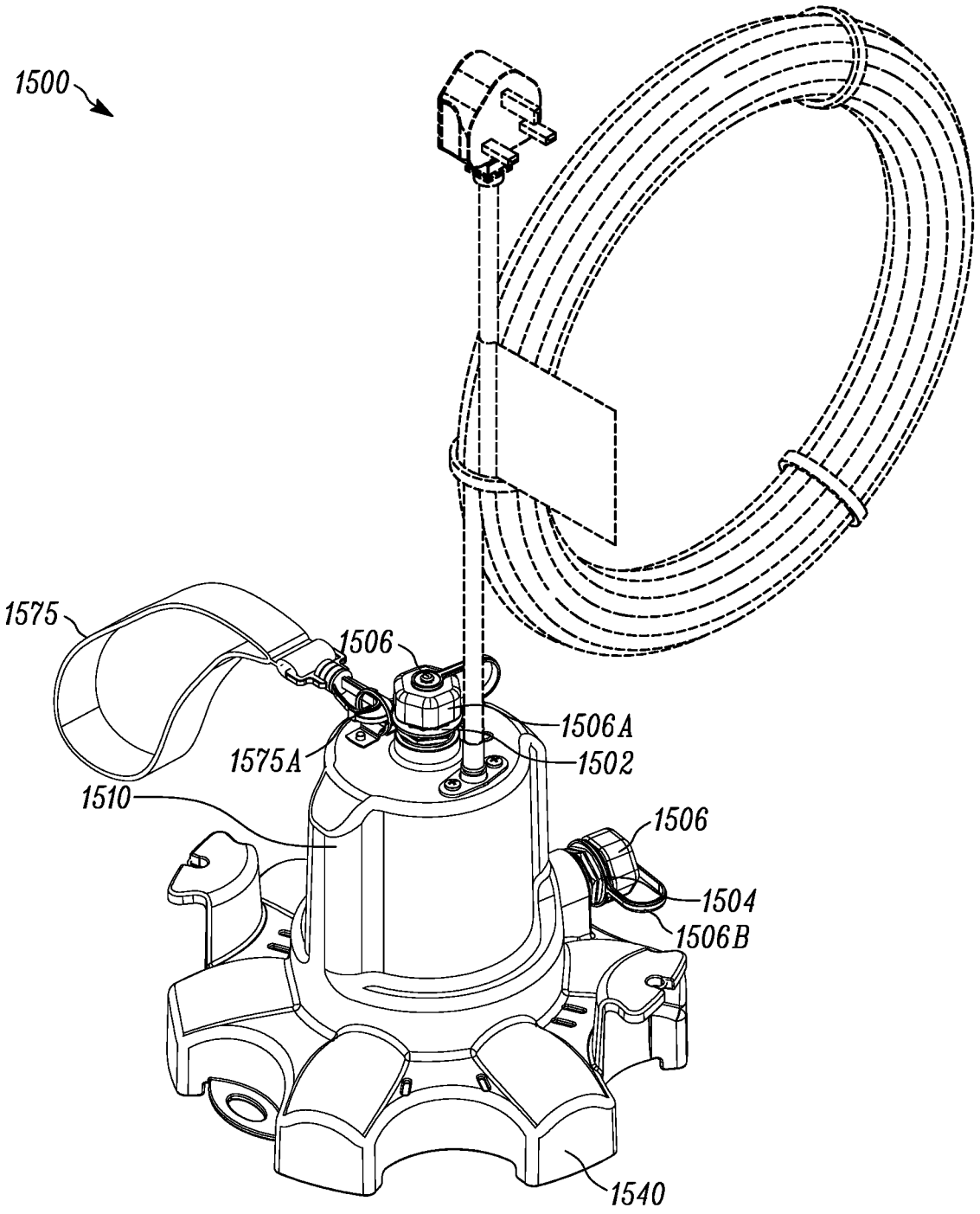
FIG. 15A is a perspective view of an alternative pump with a strap handle and caps with flat sides.
Figure 15B:
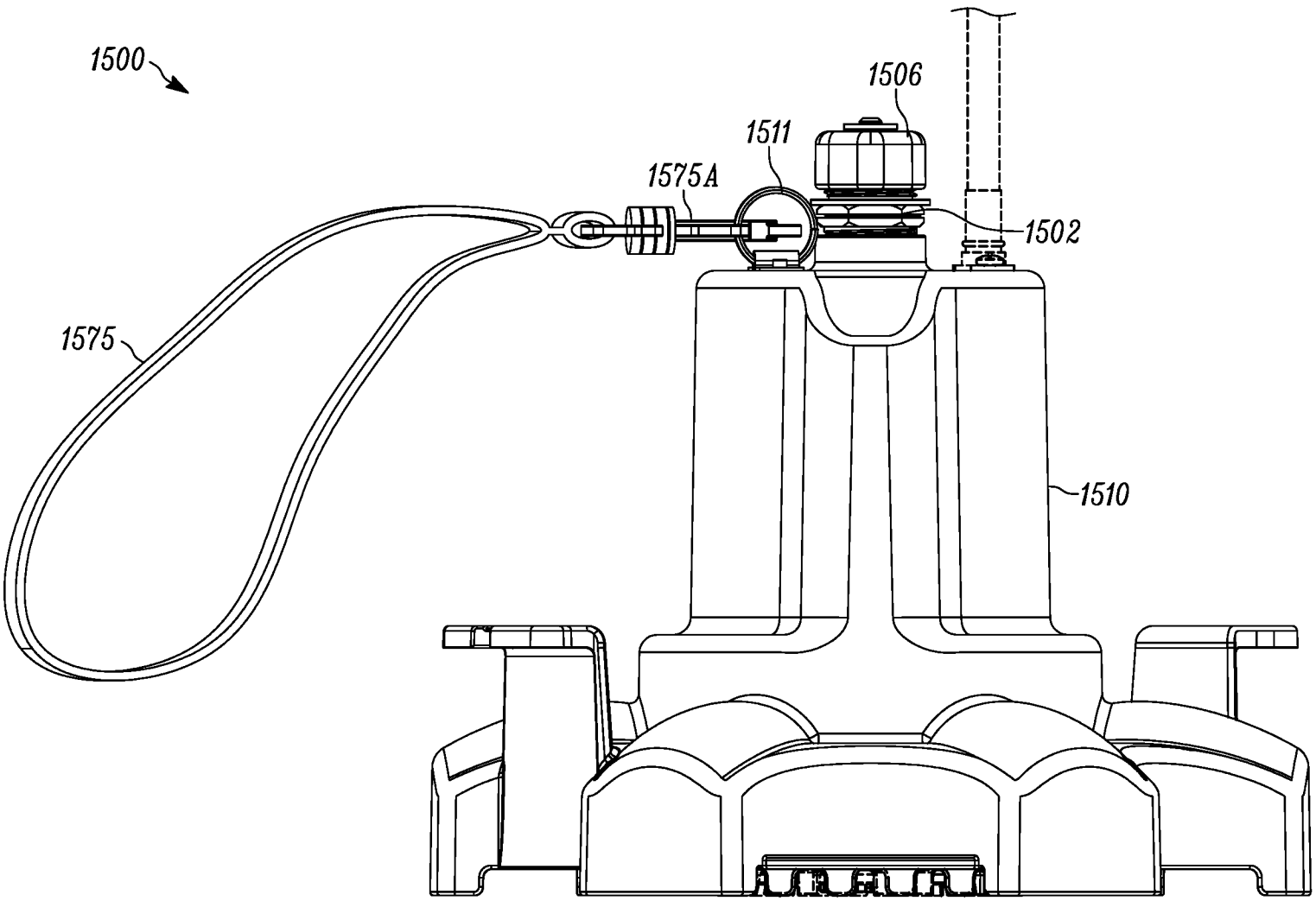
FIG. 15B is a front elevation view of the pump of FIG. 15A.

FIGS. 15A-15B illustrates a pump 1500 having two discharges 1502, 1504. The pump 1500 includes a housing 1510 which contains a motor. The pump 1500 is supported by a plurality of foot members 1540 that support the stability of the pump. In some aspects, the foot members 1540 can be adapted so that accessories such as the above-mentioned leg extensions can be connected, thereby expanding the diameter of the base of the pump 1500 to provide even further stability.

A bottom opening (not shown) provides a fluid inlet such that the pump draws in fluid into which the pump 1500 is at least partially submerged by rotating an impeller, such as the impeller of FIG. 14. The fluid is discharged through the first and second discharged 1502, 1504. The pump 1500 operates in substantially the same manner as the pumps described above. For example, in the form shown, fluid will flow through both discharge paths and exit whichever outlet has cap 1506 removed. Thus, the pump provides a first discharge passage or path and a second discharge passage or path (see, e.g., passages 1385 above), with each positioned proximate different portions of the pump motor to assist in cooling the motor. This allows the fluid to more easily cool the motor of pump 1500 during operation of the pump. The discharge passages or paths (comparable to 1385 above) are preferably interconnected so that fluid can flow from either discharge passage or path and out either outlet opening (depending on which is uncapped or open).

Each of the discharges 1502, 1504 is closed by a detachably coupled cap 1506. The caps 1506 each have an internal thread for threading onto the discharges 1502, 1504. The caps 1506 have a polygonal cross-section, with a plurality of flat sidewalls 1506A. In some forms, the cross-section is hexagonal in shape, in alternative embodiments the cross-section is octagonal. In still others, it could be triangular or rectangular in cross-section. In the form shown, the flat sidewalls 1506A are each substantially the same size and adjacent pairs of sidewalls 1506A are oriented relative to each other by substantially the same angle. The polygonal shape of the caps 1506 is configured to interact with standard wrenches or pliers to aid in removal of the caps 1506. The caps 1506 are coupled to the pump 1500 by tethers 1506B. The tethers 1506B remain attached to the caps 1506 even when the caps 1506 are unthreaded from the discharges 1502, 15004. Therefore, the caps 1506 are easier to locate when the user wishes to close one or both discharges 1502, 1504.

The pump 1500 further includes a carrying strap 1575. The carrying strap 1575 is detachably coupled to the pump housing 1510 by a clasp 1575A. The carrying strap 1575 and clasp 1575A are configured to support the entire weight of the pump 1500, such that the pump can be suspended and/or carried by the strap 1575. In some forms, a ring 1511 or other attachment structure is affixed to the pump housing 1510 to which the clasp 1575A is detachably coupled. The clasp

1575 includes a substantially C shaped body and a spring biased member configured to close the C shaped body, e.g., such as a clip. A user moves the spring biased member by overcoming the biasing spring (e.g., leaf spring, etc.) to create an opening through which the ring 1511 can be passed to couple or decouple the clasp 1575A from the pump 1500. In the form illustrated, the ring 1511 is connected to the housing via a bracket our mount, such as a two-hole U-shaped bracket (e.g., bracket, mount, clamp or strap). Together the strap 1575, clasp 1575A, ring 1511 and U-shaped bracket suspend the entire weight of pump 1500 when lifted by strap 1575.

Some embodiments may incorporate one or more features of the Wayne Water Systems ISP50 pump, which is described in U.S. patent application Ser. No. 10/233,832, filed Aug. 29, 2002, now U.S. Pat. No. 6,676,382, issued Jan. 13, 2004 and their capacitive water sensor application Ser. No. 12/944,883 filed Nov. 12, 2010, now abandoned, which are both incorporated herein by reference in their entirety. Some embodiments may also employ a capacitive water sensor to control operation of the pump, as well as other features described in U.S. patent application Ser. No. 12/944,883, filed Nov. 12, 2010, now abandoned, which is hereby incorporated by reference in its entirety. Other embodiments may employ various features of the pump parts shown in the detailed drawings and descriptions associated with U.S. Design Pat. No. D823345 which issued on Jul. 17, 2018, and which is also incorporated herein by reference in its entirety.

Other accessories or features may also be provided with any of the above-mentioned embodiments. For example, in some forms, the pump may include an indicator to indicate if the thermal cutoff has disabled the pump and/or if the pump is powered and running. In a preferred form, the indicator will be a light, such as an LED, for giving a user a visual indication as to the status of the pump (e.g., indicating normal operation, indicating the pump has been shutoff due to thermal cutoff activation and needs to be reset or unplugged, both of the above, etc.). The indicator may be located anywhere in connection with the pump, such as on the pump housing or in the pump power cord. In some forms, the LED indicator may be a single LED that simply illuminates when the thermal cutoff has disabled the pump in order to signify to the user to reset or unplug the pump. In other forms, the LED may be a multi-color LED that illuminates in a first color to indicate regular operation of the pump or that the pump is powered and running, and illuminates in a second color to indicate the thermal cutoff has been triggered or activated and, thus, the pump is disabled and needs to be reset or unplugged. In yet other embodiments, the pump may be equipped with a plurality of LEDs each being a different color to indicate a different state of the pump (e.g., green for powered and running, red for depowered due to thermal cutoff activation, yellow for powered but not running as desired, etc.). In other forms, the indicator may simply blink to signify different states or conditions (e.g., steady on to indicate powered and running, blinking on to indicate depowered due to thermal cutoff activation, blinking at different intervals, such as long slow blinks vs. short quick blinks, to indicate a different pump status or state, etc.). In a preferred form, a power cord with LEDs is disclosed as an accessory for a pump which can indicate a pump status, state or condition.

Figure 16:
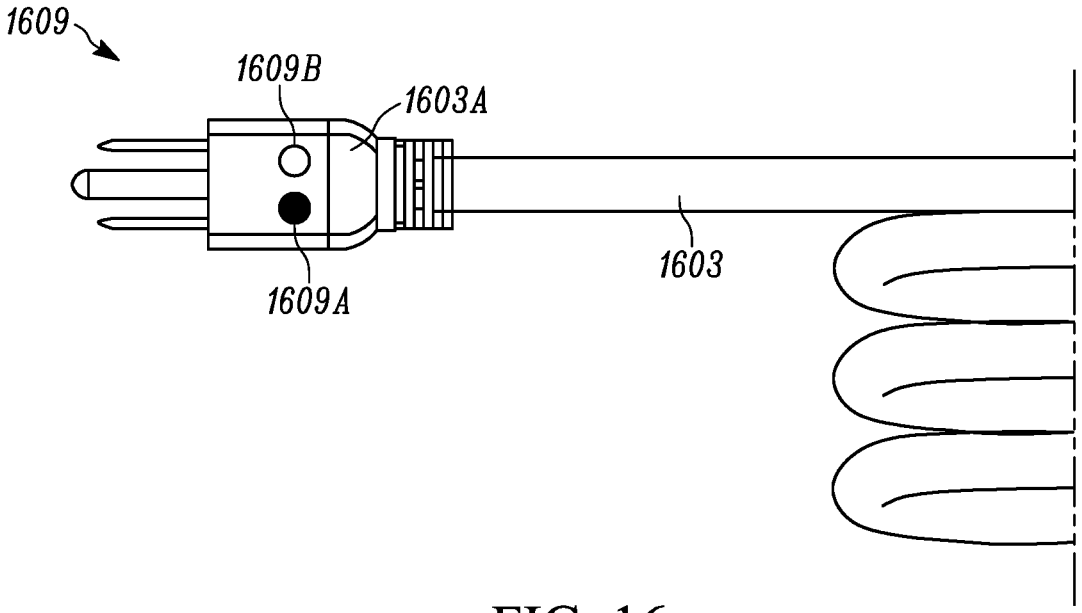
FIG. 16 is an enlarged top view of a portion of a power cord and power cord plug for use with the pumps disclosed herein.

In FIG. 16, an exemplary indicator is illustrated by reference numeral 1609 which is integrated into power cord 1603. In the form shown, the indicator includes a first light, LED 1609*a*, and a second light, LED 1609*b*, for indicating different pump states or conditions. More particularly, in the form shown, the first LED 1609*a* is a red LED and the second LED 1609*b* is a green LED, and the indicator 1609 is integrated into the plug 1603*a* of the power cord 1603. The indicator 1609 is configured to illuminate the green LED 1609*b* when the pump draws more than 0.5 Amperes (green >0.5 A) and will illuminate the red LED when the pump draws less than 0.5 Amperes (red <0.5 A). The amperage selected is exemplary and the circuit can be setup to illuminate the green LED at any current or voltage relating to normal pump operation and to illuminate the red LED at any current or voltage that is less than normal operating current or voltage, but greater than the current or voltage associated with the operation of the heater keeping the TCO activated (or self-holding).

It should be understood that the indicator can be used in other embodiments as discussed above (e.g., a single LED configuration solely alerting to a thermal cutoff activation, a single LED that is illuminated in different manners to indicate different states or conditions, a single multi-colored LED capable of illuminating in different colors to indicate different states or conditions, a multi-LED configuration with each LED being a different color to indicate a different state or condition, etc.). While a pump is disclosed, it should also be understood that the thermal cutoff indicator disclosed herein may be used with any electrical device that would benefit from utilizing such a thermal cutoff.

In a preferred form, the indicator 1609 will be used with a pump for pumping fluid. For example, in one form a utility pump like those discussed above is provided with such an indicator. The pump includes a pump housing, a motor disposed at least partially within the pump housing, an impeller connected to a motor shaft of the motor for pumping fluid, first and second discharges for discharging the fluid pumped by the pump, first and second discharge caps for respectively sealing the first and second discharges, and wherein the pump defines a first fluid discharge passage and a second fluid discharge passage, both the fluid discharge passages being interconnected and in fluid communication with the first and second discharges, with the first and second fluid discharge passages positioned proximate different portions of the motor to assist with cooling the motor during pump operation.

In one form, the pump housing forms at least a portion of the first and second fluid discharge passages and directs fluid around different portions of the motor to cool the motor. The pump includes a primary thermal cutoff for depowering the pump when a first predetermined temperature is reached or exceeded and a secondary or redundant thermal cutoff for depowering the pump when a second predetermined temperature is reached or exceeded. In one form, the first predetermined temperature is lower than the second predetermined temperature so that the secondary or redundant thermal cutoff is used as a fail-safe or back-up thermal cutoff to activate if the first or primary thermal cutoff fails. An indicator 1609 is included for indicating if the primary thermal cutoff has depowered the pump due to the first predetermined temperature being reached or exceeded to alert a user that the pump needs to be unplugged or reset. In one form, the indicator is a light that is illuminated when the primary thermal cutoff has depowered the pump. The light could be any form of light (e.g., incandescent, low voltage (e.g., 3V-24V), LED, LCD, etc.), however, in a preferred form it will be one or more LED lights.

As mentioned above, the indicator or at least indicator light may be located anywhere on the pump. In preferred forms, the light will be located on either on the pump housing or on a power cord of the pumping apparatus so that it is readily visible to a pump user or operator. In the form shown in FIG. 16, the light is a plurality of LEDs 1609*a*, 1609*b* located in the plug portion 1603*a* of the power cord 1603. The first LED 1609*a* has a first color for indicating a first status of the pump and the second LED 1609*b* has a second color, different from the first, for indicating a second status of the pump. In the form shown, the first LED 1609*a* is a red LED that illuminates in a red color to indicate the thermal cutoff has been activated and the pump needs to be reset or unplugged. Resetting may entail unplugging/disconnecting the pump or it may entail operation of an actuator, such as a reset switch or button, depending on how the pump is configured. The second LED 1609*b* is a green LED that illuminates in a greed color to indicate the pump has power and is operating normally. In the form shown, the second LED 1609*b* will illuminate green when the current drawn by the pump is more than 0.5 Amperes (green >0.5 A) and the first LED 1609*a* will illuminate red when the current drawn by the pump is less than 0.5 Amperes (red <0.5 A). In the form shown, only one LED 1609*a*, 1609*b* will be on at a time (e.g., either 1609*a* on and 1609*b* off, or 1609*a* off and 1609*b* on). However, in alternate forms the indicator may be configured to transition from one LED on to the other with a period of time where both are on. In still other forms, additional LEDs may be included in the indicator 1609 in order to provide other status or condition information or states. Similarly, the 0.5 A current threshold is provided as an exemplary current value or threshold and it should be appreciated in other embodiments a different threshold current value may be selected (e.g., it may be any current that is less than the normal operating current or greater than the current required to operate the heater).

In FIG. 16, the LEDs 1609*a*, 1609*b* are located in the plug 1603*a* of power cord 1603 and are preferably overmolded with a translucent material so that the illuminated colors of LEDs 1609*a*, 1609*b* are readily visible and yet sealed to protect from exposure to fluid, humidity or just a generally wet environment. In a preferred form, the overmolding will be clear or transparent in order to make LEDs 1609*a*, 1609*b* very clearly visible. In this way, a power cord with LEDs is provided that may be used to provide information such as on a pump condition, state or status.

Again, while two LEDs are shown 1609*a*, 1609*b*, it should be understood that in alternate embodiments, the indicator may use a single LED. The single LED could be illuminated in different manners to correspond to different pump states (e.g., steady on to me powered and running, long slow blink to mean thermal cutoff activation requiring resetting or unplugging of the pump. In other forms, the LED is a multi-color LED that illuminates in a first color to indicate the pump is powered and operating and illuminates in a second color, different than the first color, to indicate the primary thermal cutoff has depowered the pump. In still other forms, the indicator 1609 could be placed elsewhere on the pump, such as on the pump housing.

In still other forms, a regular utility pump or other pumps may be used in connection with the indicator. For example, a utility pump that does not have two discharge ports or passageways may be used in connection with the indicator, but rather a pump with a single discharge may be used (e.g., a side discharge or a top discharge, etc.). The pump will include a pump housing, a motor disposed at least partially within the pump housing, an impeller connected to a motor shaft of the motor for pumping fluid, a primary thermal cutoff for depowering the pump when a first predetermined temperature is reached or exceeded, and a secondary or redundant thermal cutoff for depowering the pump when a second predetermined temperature is reached or exceeded. In this way, the second thermal cutoff serves as a fail-safe or back-up thermal cutoff for the pump. In a preferred form, the primary thermal cutoff is a self-locking thermal cutoff and the first predetermined temperature is lower than the second predetermined temperature. In alternate embodiments, the secondary thermal cutoff may be a self-locking thermal cutoff or a non-self-locking thermal cutoff. The former offering the added protection of not letting the pump cycle on and off when the temperature transitions between below the thermal cutoff threshold and above.

In addition to the above embodiments, it should be understood that a plurality of additional methods are also disclosed herein relating to the above embodiments. For example, a method of controlling a pump or pump operation is disclosed herein the includes providing a pump housing, a motor disposed at least partially within the pump housing, an impeller connected to a motor shaft of the motor for pumping fluid, a primary thermal cutoff for depowering the pump when a first predetermined temperature is reached or exceeded, and a secondary or redundant thermal cutoff for depowering the pump when a second predetermined temperature is reached or exceeded, and depowering the pump via the primary thermal cutoff when the first predetermined temperature is reached or exceeded, and via the secondary or redundant thermal cutoff when the second predetermined temperature is reached or exceeded. In some forms, the first thermal cutoff is a self-locking thermal cutoff and the method further requires a user to take an action to reset the self-locking thermal cutoff and allow the pump to be operated again. The action the user is required to take to reset the self-locking thermal cutoff may be an affirmative action comprising at least operating an actuator to reset the self-locking thermal cutoff and allow the pump to be used again, or it may entail requiring the user to unplug the pump to reset the self-locking thermal cutoff to allow the pump to be used again.

The method may include an indicator and indicating on the indicator if the primary thermal cutoff has depowered the pump due to the first predetermined temperature being reached or exceeded to alert a user that the pump needs to be unplugged or reset. In one form, the indicator is a light and the method comprises illuminating the light when the primary thermal cutoff has depowered the pump. For example, the light may be an LED located either on the pump housing or on a power cord connected to the motor and illuminating the light comprises illuminating the LED when the primary thermal cutoff has depowered the pump. In one form, the LED is located in a plug portion of the power cord and illuminating the LED comprises illuminating the LED at the plug portion of the power cord. In another form, the LED may be a multi-color LED and illuminating the LED comprises illuminating the LED in a first color to indicate the pump is powered and operating and illuminating the LED in a second color, different than the first color, to indicate the primary thermal cutoff has depowered the pump.

The method of claim 43 wherein the LED comprises a first LED and a second LED and illuminating the LED comprises illuminating the first LED in a first color to indicate the pump is powered and operating, and illuminating the second LED in a second color, different than the first color, to indicate the primary thermal cutoff has depowered the pump. Alternatively, the method may include first and second LEDs that are located in a plug portion of the power cord as discussed above, with the first LED is a green LED and the second LED is a red LED, and the method comprising illuminating the first LED in green when the pump is powered and operating, and illuminating the second LED in red when the primary thermal cutoff has depowered the pump to indicate to the user the pump must be unplugged or reset. As also discussed above, the method may also entail overmolding the first and second LEDs in the plug portion of the power cord with a translucent material.

Figure 17:
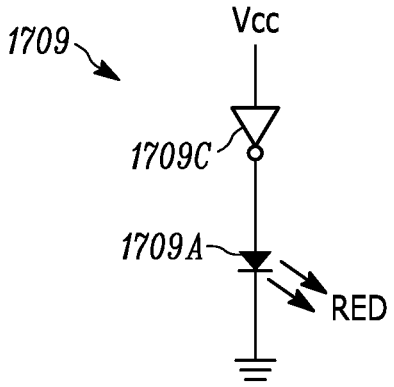
FIG. 17 is a circuit diagram of a first circuit for indicating an active thermal cutoff state of a pump.
Figure 18:
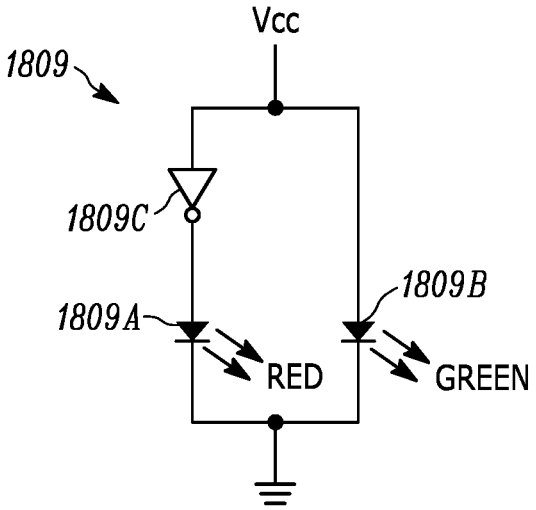
FIG. 18 is a circuit diagram of a second, alternate circuit for indicating a plurality of device conditions, states or statuses.

In FIG. 17, an embodiment of a single LED indicator circuit is illustrated. In this form, the indicator 1709 has a NOT gate 1709*c* in series with LED 1709*a* so that the LED is only illuminated when a logic zero or low (logic 0) is present. In FIG. 18, an alternative embodiment is illustrated that has two LEDs 1809*a*, 1809*b*. The red LED 1809*a* only illuminates when the current draw or voltage is a logic zero or low (logic 0) because of NOT gate 1809*c* (like the circuit in FIG. 17). Conversely, green LED 1809*b* only illuminates when a logic one or high (logic 1) is present. FIGS. 17 and 18 are merely representative examples of circuits that may be used for indicators 1709, 1809, thus, it should be understood that numerous other circuit configurations could be used for indicators 1709, 1809.

Figure 19:
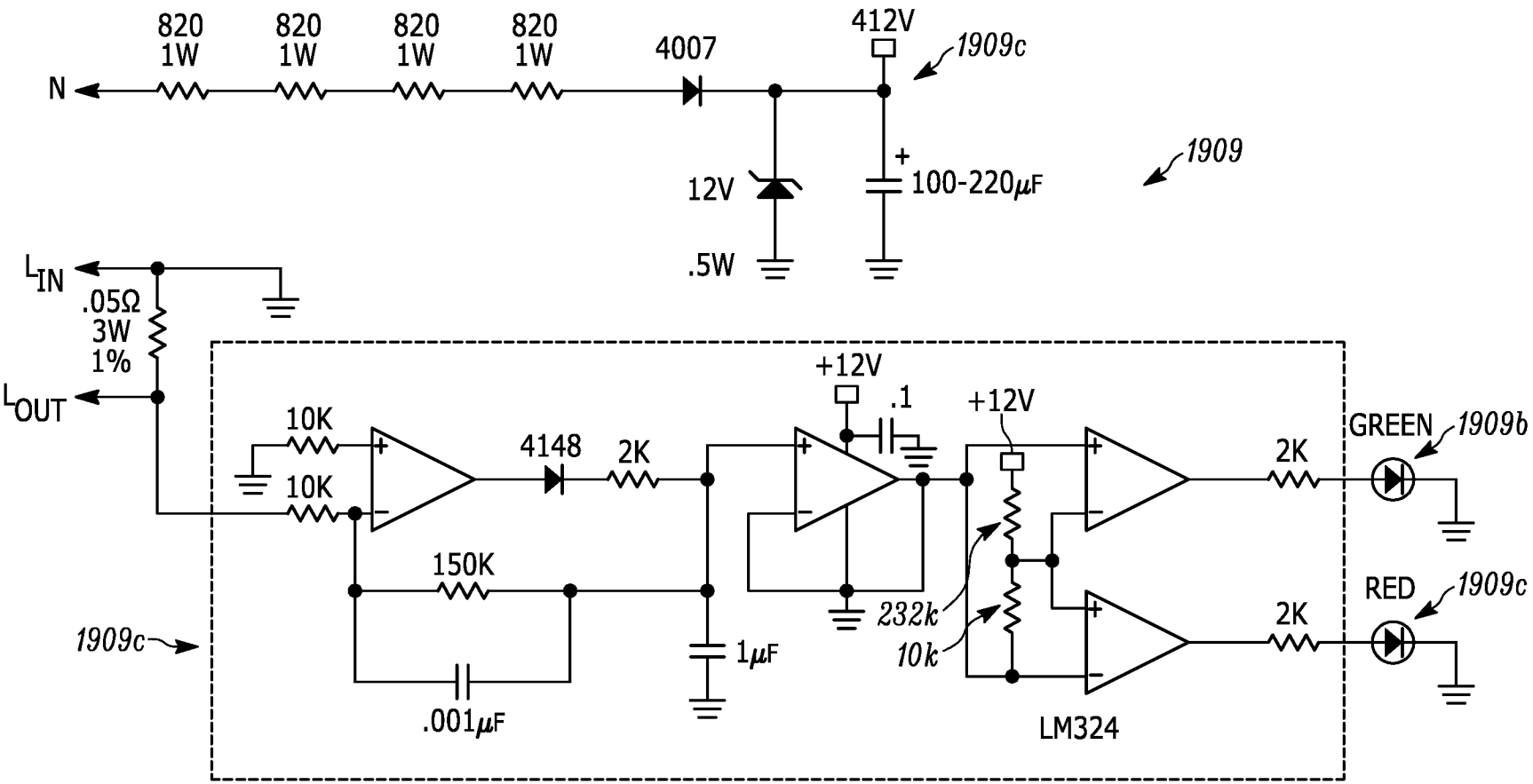
FIG. 19 is a circuit diagram of another circuit for indicating a plurality of device conditions, states or statuses.

In FIG. 19, an alternate circuit is illustrated for a display or indicator identifying a current state of the pump. In keeping with prior practice, common features of this embodiment to prior embodiments will use the same latter two-digit reference numeral with the prefix "19" to distinguish this embodiment from others. In the form shown, the indicator 1909 includes a power supply 1909*d*, a logic gate 1909*c* and first and second LEDs 1909*a*, 1909*b*, respectively. Power supply 1909*d* preferably includes a power source or input (e.g., 115-230$V_{AC}$), a voltage divider made up of a plurality of step-down resistors in series with one another, a rectifier made up of a plurality of diodes. Together these items step down the AC voltage to a rough or pulsating DC voltage, which in turn is filtered or smoothed out by a capacitor to generate 12$V_{DC}$ which is used to power the remainder of the display or indicator 1909 circuitry including logic gate 1909*c*, red LED 1909*a* and green LED 1909*b*. In the form shown, the display or indicator 1909 will illuminate the green LED 1909*b* when power is supplied to the pump and the pump is properly running. Conversely, the display or indicator 1909 will illuminate the red LED 1909*a* when power is applied to the pump, but the pump is not properly running, (e.g., because of the self-hold thermal cutoff switch (TCO) being triggered), in order to signify to the pump user that the pump needs to be unplugged or reset.

Figure 20:
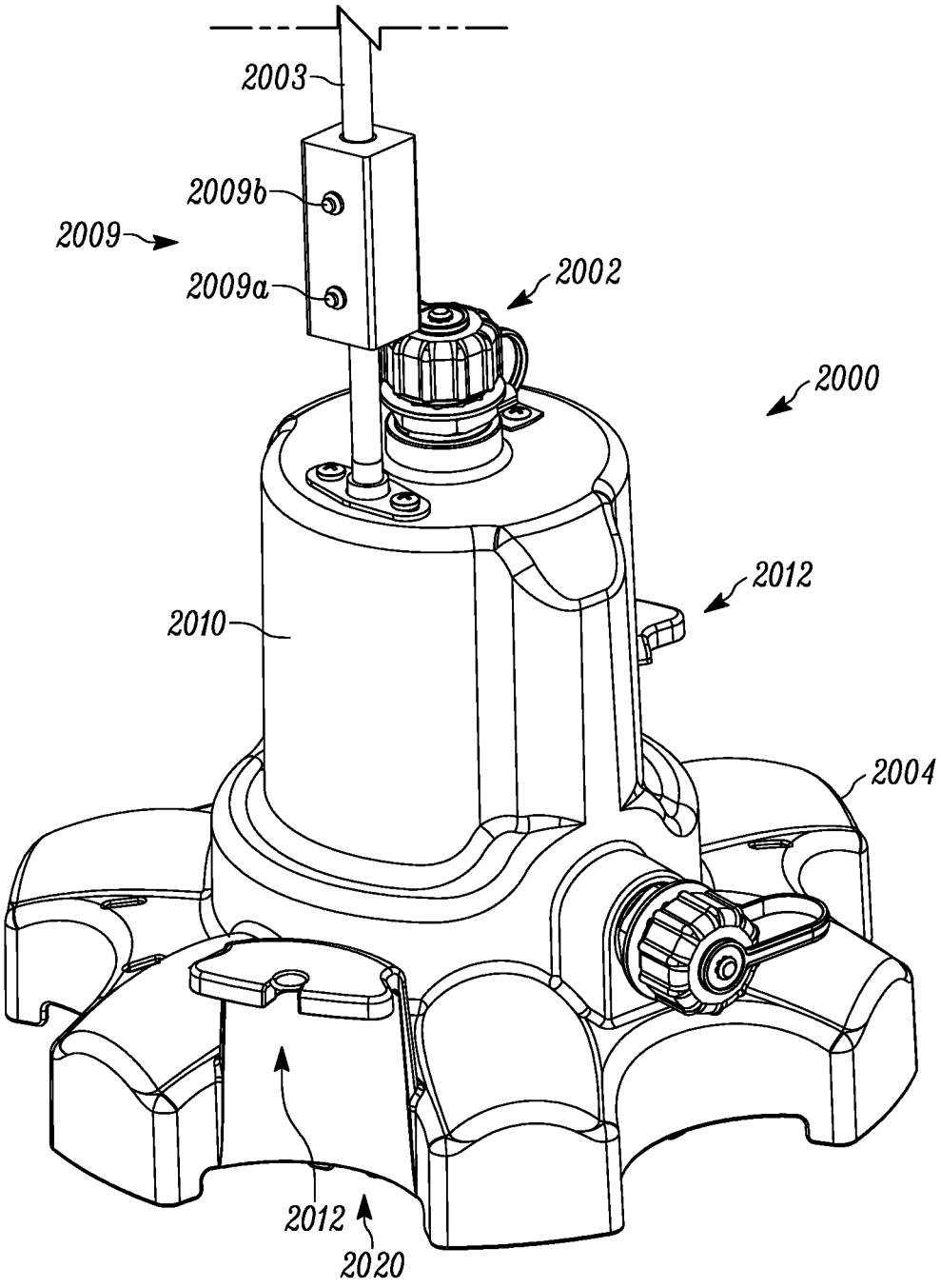
FIG. 20 is a perspective view of a pump with an alternate power cord having a display or indicator for displaying a plurality of device conditions, states or statuses.

In FIG. 20, a pump is shown having an alternate display or indicator in accordance with an embodiment of the invention. In keeping with the prior numbering scheme, similar items will be identified by similar latter two-digit reference numerals and the prefix "20". Thus, the pump is referred to generally by reference numeral 2000 and includes a pump housing 2010. In the form shown, the pump has a single inlet located below the unit and surrounded by a filter 2020 and a plurality of discharge outlets, e.g., first outlet 2002 and second outlet 2004. In a preferred form, the pump 2000 further includes an integral handle 2012 which may be used as a cord wrap structures as well. Unlike prior embodiments, however, pump 2000 includes a display or indicator 2009 that is located on or at a pump side of the power cord 2003. Conversely, the indicator 1609 of FIG. 16 was located at the plug end of power cord 1603. In some forms, it may be desirable to have the indicator 2009 located nearer the pump 2000 or pump housing 2010 instead of at the plug end of the power cord (as shown in FIG. 16) in order to indicate to the user at the pump that the pump is either working properly (e.g., having green LED 2009*b* illuminated) or that it needs to be reset (e.g., having red LED 2009*a* illuminated). In other forms, the opposite may be true, and it may be more desirable to have the indicator placed at the plug end of the power cord as is illustrated in FIG. 16. In still other forms, it may be desirable to have indicators located at both ends of the power cord (e.g., a combination of both FIG. 16 and FIG. 20) so that a user can tell if the pump needs to be reset at either the plug end of the power cord or the pump end of the power cord. In the form shown, the green LED 2009*b* is illuminated when the pump is powered and operating normally (e.g., when the indicator circuit draws or sees greater than or equal to half of an Ampere of current (≥0.5 A)) and the red LED 2009*a* is illuminated when the pump is powered but not able to operate because the TCO has been triggered (e.g., when the indicator circuit draws or sees less than half an Ampere of current (<0.5 A)) and thus the pump needs to be reset (e.g., unplugged and plugged back in, a reset switch is actuated, etc.). It should be understood that 0.5 A threshold is used as an exemplary value, but in alternate embodiments it could be any current value that is less than the normal operating current or greater than the current required to run the heater.

Figure 21:
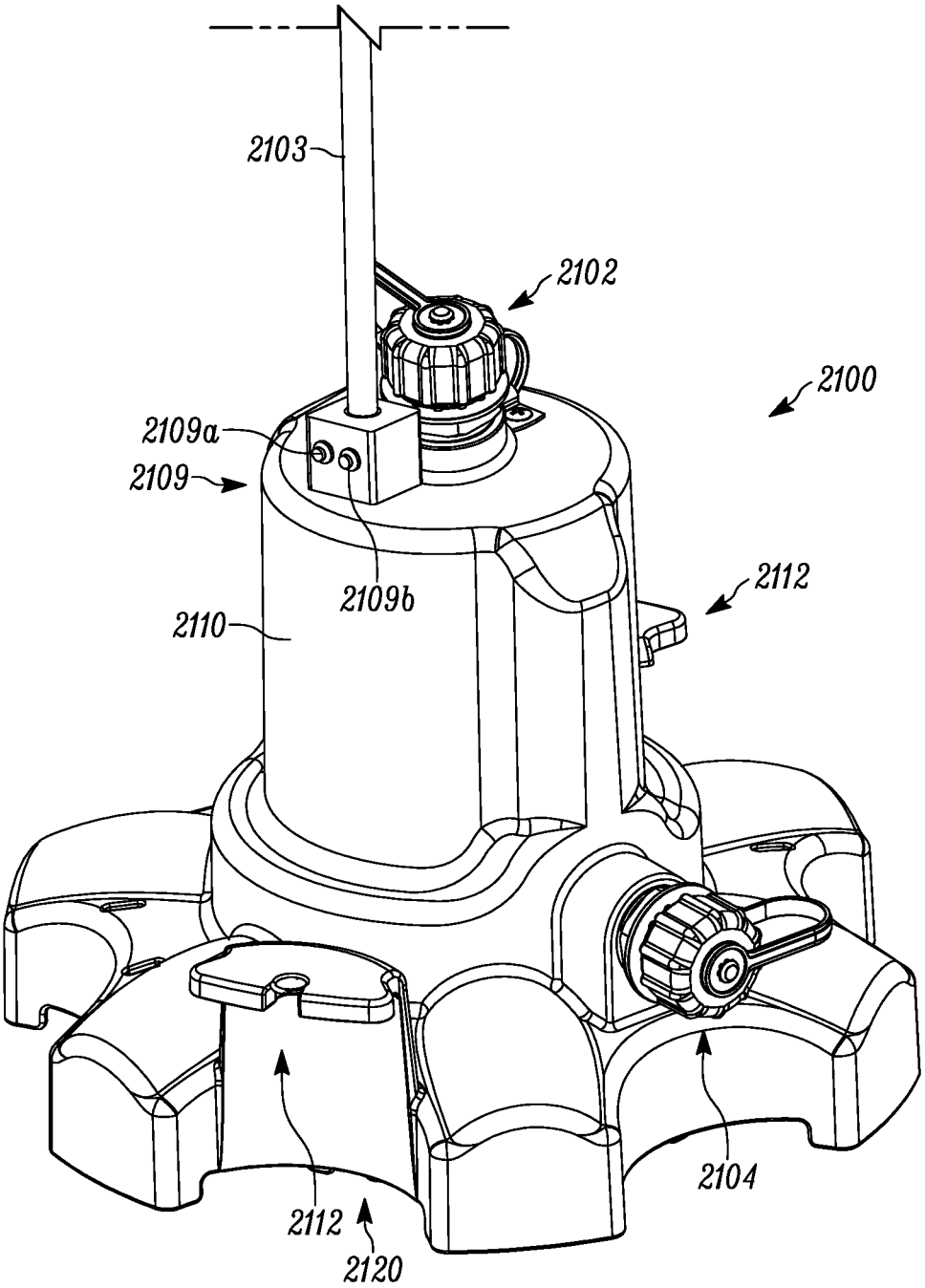
FIG. 21 is a perspective view of a pump with an alternate display or indicator placement for displaying a plurality of device conditions, states or statuses.

As mentioned above, it may be desirable to locate the display or indicator on the pump itself. An exemplary embodiment of same is illustrated in FIG. 21. More particularly, in this embodiment, the display or indicator 2109 is illustrated mounted on the housing 2110 of pump 2100. Like prior pump examples, pump 2100 includes an inlet surrounded by a filter 2120, a first discharge or discharge port 2102 and a second discharge or discharge port 2104. In the form shown, the display or indicator 2109 comprises a module that is connected to the pump housing and from which the power cord 2103 extends. The indicator 2109 includes red LED 2109*a* and green LED 2109*b* which operate similar to the indicators discussed above. In alternate forms, however, the display or indicator 2109 may simply comprise LEDs extending from the housing 2110 itself, rather than a module or indicator housing. In such forms, the LEDs 2109*a*, 2109*b* and associated electronics with same (e.g., logic gates, etc.) would be located in an area of the pump housing 2110 that does not also serve as a portion of the internal fluid flow path or water jacket of pump 2100. For example, in some forms, such circuitry and LEDs may be located in one of the foot members or feet that extend out around the base of the pump 2100. In a preferred form, however, the indicator 2109 will be positioned higher on pump 2100 in order to keep the indicator 2109 visible even when the lower portions of the pump 2100 are submerged in liquid that is to be pumped by pump 2100.

In some forms where it is desired to locate a display or indicator at both the pump end and the plug end of the power cord, the display or indicator 2109 may be used as the indicator at the pump end of the setup and another display or indicator like the one depicted in FIG. 16 may be located near the plug end of the power cord 2103. While FIG. 16 illustrates the display or indicator being disposed within the plug itself, it should be understood that in alternate forms, the display or indictor may be positioned further down on the power cord using a structure similar to that shown in FIG. 20.

In addition to the above mentioned pumps and methods, it should be understood that at a more basic level an indicator is disclosed herein comprising a first thermal cutoff for depowering an electrical device connected to the indicator when a first predetermined temperature is reached or exceeded, the first thermal cutoff being a self-holding thermal cutoff; and a second thermal cutoff for depowering the electrical device when a second predetermined temperature is reached or exceeded, the first predetermined temperature being higher than the second predetermined temperature. Similarly, a related method for controlling an indicator is also disclosed herein comprising providing an indicator having a first thermal cutoff and a second thermal cutoff, depowering a device to which the indicator is connected when a first predetermined temperature is reached or exceeded as detected by the first thermal cutoff, and depowering the device to which the indicator is connected when a second predetermined temperature is reached or exceeded as detected by the second thermal cutoff, the second predetermined temperature being higher than the first predetermined temperature so that the second thermal cutoff is used as a back-up or fail-safe thermal cutoff to ensure depowering of the device should the first thermal cutoff fail. As mentioned above, these methods may also entail providing a plurality of displays or indicators such as one on or near the plug end of the power cord and another on or near the pump end of the system (e.g., on the pump end of the power cord or on the pump itself).

It should be understood that the embodiments discussed herein are simply meant as representative examples of how the concepts disclosed herein may be utilized and that other system/method/apparatus are contemplated beyond those few examples. In addition, it should also be understood that features of one embodiment may be combined with features of other embodiments to provide yet other embodiments as desired, for example, the multiple discharge pumps may include a self-locking TCO to thermally control said pumps. Alternatively, non-multiple discharge pumps may include the TCOs and/or indicators disclosed herein. For example, in one embodiment a fluid pumping apparatus is claimed having a pump housing, a motorized pump, a self-locking thermal cutoff configured to control the connection between the motorized pump and a power supply or circuit, wherein the self-locking thermal cutoff disconnects or interrupts the motorized pump from the power supply or circuit when a temperature of the motorized pump exceeds a predetermined temperature.

What is claimed is:

1. A pump comprising:

a pump housing having an upper portion and a lower portion, the lower portion of the pump housing extending radially outward of the upper portion to provide stability;

a motor disposed at least partially within the pump housing;

an impeller connected to a motor shaft of the motor for pumping fluid;

a first discharge for discharging the fluid pumped by the pump in a direction parallel to a longitudinal axis;

a second discharge for discharging the fluid pumped by the pump in a direction perpendicular to the longitudinal axis;

first and second discharge caps for respectively sealing the first and second discharges;

a primary thermal cutoff for depowering the pump when a first predetermined temperature is reached or exceeded and a secondary or redundant thermal cutoff for depowering the pump when a second predetermined temperature is reached or exceeded; and an indicator for indicating an operational status of the pump;

wherein the pump defines a first fluid passage and a second fluid passage, both the fluid passages being interconnected and in fluid communication with the first and second discharges, at least a portion of the first fluid passage extending parallel to the longitudinal axis and along a first portion of the motor and at least a portion of the second fluid passage extending parallel to the longitudinal axis and along a second portion of the motor different from the first portion to assist with cooling the motor during pump operation.

2. The pump of claim 1 wherein the pump housing forms at least a portion of the first and second fluid passages and directs fluid around different portions of the motor to cool the motor.

3. The pump of claim 1 wherein the first predetermined temperature is lower than the second predetermined temperature.

4. The pump of claim 1 wherein the indicator is for indicating if the primary thermal cutoff has depowered the pump due to the first predetermined temperature being reached or exceeded to alert a user that the pump needs to be unplugged or reset.

5. The pump of claim 4 wherein the indicator is a light that is illuminated when the primary thermal cutoff has depowered the pump.

6. The pump of claim 5 wherein the light is an LED located either on the pump housing or on a power cord of the pumping apparatus.

7. The pump of claim 6 wherein the LED is a multi-color LED that illuminates in a first color to indicate the pump is powered and operating and illuminates in a second color, different than the first color, to indicate the primary thermal cutoff has depowered the pump.

8. The pump of claim 6 wherein the LED comprises a first LED that illuminates in a first color to indicate the pump is powered and operating and a second LED that illuminates in a second color, different than the first color, to indicate the primary thermal cutoff has depowered the pump.

9. The pump of claim 4 wherein the indicator is positioned at or near the pump or at or near a plug end of a power cord that is used to connect the pump to a power supply.

10. The pump of claim 1 wherein the first fluid passage guides fluid from the impeller to the first discharge and the second fluid passage guides fluid from the impeller to the second discharge.

* * * * *